US007839357B2

(12) United States Patent
Kawahara et al.

(10) Patent No.: US 7,839,357 B2
(45) Date of Patent: Nov. 23, 2010

(54) IMAGE DISPLAY APPARATUS FOR WRITING DISPLAY INFORMATION WITH REDUCED ELECTRIC CONSUMPTION

(75) Inventors: Isao Kawahara, Osaka-fu (JP); Kunio Sekimoto, Osaka-fu (JP)

(73) Assignee: Panasonic Corporation, Osaka (JP)

( * ) Notice: Subject to any disclaimer, the term of this patent is extended or adjusted under 35 U.S.C. 154(b) by 1447 days.

(21) Appl. No.: 10/903,528

(22) Filed: Jul. 30, 2004

(65) Prior Publication Data

US 2005/0001860 A1 Jan. 6, 2005

Related U.S. Application Data

(62) Division of application No. 09/929,946, filed on Aug. 15, 2001, now Pat. No. 6,791,515.

(30) Foreign Application Priority Data

Aug. 23, 2000 (JP) ..... 2000-252096
Sep. 11, 2000 (JP) ..... 2000-274621

(51) Int. Cl.
*G09G 5/10* (2006.01)

(52) U.S. Cl. ..... 345/60; 345/63; 345/690

(58) Field of Classification Search ..... 345/60–72, 345/204, 690–695, 596–617; 315/169.1–169.4
See application file for complete search history.

(56) References Cited

U.S. PATENT DOCUMENTS 5,229,762 A 7/1993 Itoh et al. ..... 340/793
6,061,040 A * 5/2000 Onodera et al. ..... 345/67
6,310,588 B1 * 10/2001 Kawahara et al. ..... 345/63
6,323,880 B1 * 11/2001 Yamada ..... 345/690
6,429,833 B1 * 8/2002 Ryeom et al. ..... 345/63
6,448,960 B1 * 9/2002 Shigeta ..... 345/204
6,525,702 B1 * 2/2003 Van Dijk ..... 345/63
6,614,413 B2 9/2003 Tokunaga et al. ..... 345/63
6,630,917 B1 * 10/2003 Van Dijk ..... 345/60
7,053,868 B1 5/2006 Kojima

FOREIGN PATENT DOCUMENTS

| | | |
|---|---|---|
| JP | 9-179522 | 7/1997 |
| JP | 10-187093 | 7/1998 |
| JP | 2000-66638 | 3/2000 |
| WO | WO 99/55078 | 10/1999 |

* cited by examiner

*Primary Examiner*—Amare Mengistu
*Assistant Examiner*—Jennifer Zubajlo

(57) ABSTRACT

An image display apparatus for displaying gray-scale images by writing display information to an image display area of a panel. The display information includes values of a plurality of sub-fields that constitute one field. The image display apparatus converts an input image signal into a piece of display information so that a difference between sub-fields in correspondence with each other in adjacent high gray-scale levels becomes less. The image display apparatus displays a gray-scale image in accordance with the piece of display information.

20 Claims, 26 Drawing Sheets

FIG. 2

| INPUT GRAY-SCALE LEVEL | DISPLAY GRAY-SCALE LEVEL | SUB-FIELD LUMINANCE WEIGHT | | | | | |
|---|---|---|---|---|---|---|---|
| | | 1 | 2 | 4 | 8 | 16 | 32 |
| 0 | 0 | | | | | | |
| 1 | 1 | 1 | | | | | |
| 2 | 2 | | 1 | | | | |
| 3 | 3 | 1 | 1 | | | | |
| 4 | 4 | | | 1 | | | |
| 5 | 5 | 1 | | 1 | | | |
| 6 | 6 | | 1 | 1 | | | |
| 7 | 7 | 1 | 1 | 1 | | | |
| 8 | 8 | | | | 1 | | |
| 9 | 9 | 1 | | | 1 | | |
| 10 | 10 | | 1 | | 1 | | |
| 11 | 11 | 1 | 1 | | 1 | | |
| 12 | 12 | | | 1 | 1 | | |
| 13 | 13 | 1 | | 1 | 1 | | |
| 14 | 14 | | 1 | 1 | 1 | | |
| 15 | 15 | 1 | 1 | 1 | 1 | | |
| 16 | 16 | | | | | 1 | |
| 17 | 16 | | | | | 1 | |
| 18 | 18 | | 1 | | | 1 | |
| 19 | 18 | | 1 | | | 1 | |
| 20 | 20 | | | 1 | | 1 | |
| 21 | 20 | | | 1 | | 1 | |
| 22 | 22 | | 1 | 1 | | 1 | |
| 23 | 22 | | 1 | 1 | | 1 | |
| 24 | 24 | | | | 1 | 1 | |
| 25 | 24 | | | | 1 | 1 | |
| 26 | 24 | | | | 1 | 1 | |
| 27 | 24 | | | | 1 | 1 | |
| 28 | 28 | | | 1 | 1 | 1 | |
| 29 | 28 | | | 1 | 1 | 1 | |
| 30 | 28 | | | 1 | 1 | 1 | |
| 31 | 28 | | | 1 | 1 | 1 | |
| 32 | 32 | | | | | | 1 |
| 33 | 32 | | | | | | 1 |
| 34 | 32 | | | | | | 1 |
| 35 | 32 | | | | | | 1 |
| 36 | 36 | | | 1 | | | 1 |
| 37 | 36 | | | 1 | | | 1 |
| 38 | 36 | | | 1 | | | 1 |
| 39 | 36 | | | 1 | | | 1 |
| 40 | 40 | | | | 1 | | 1 |
| 41 | 40 | | | | 1 | | 1 |
| 42 | 40 | | | | 1 | | 1 |
| 43 | 40 | | | | 1 | | 1 |
| 44 | 40 | | | | 1 | | 1 |
| 45 | 40 | | | | 1 | | 1 |
| 46 | 40 | | | | 1 | | 1 |
| 47 | 40 | | | | 1 | | 1 |
| 48 | 48 | | | | | 1 | 1 |
| 49 | 48 | | | | | 1 | 1 |
| 50 | 48 | | | | | 1 | 1 |
| 51 | 48 | | | | | 1 | 1 |
| 52 | 48 | | | | | 1 | 1 |
| 53 | 48 | | | | | 1 | 1 |
| 54 | 48 | | | | | 1 | 1 |
| 55 | 48 | | | | | 1 | 1 |
| 56 | 56 | | | | 1 | 1 | 1 |
| 57 | 56 | | | | 1 | 1 | 1 |
| 58 | 56 | | | | 1 | 1 | 1 |
| 59 | 56 | | | | 1 | 1 | 1 |
| 60 | 56 | | | | 1 | 1 | 1 |
| 61 | 56 | | | | 1 | 1 | 1 |
| 62 | 56 | | | | 1 | 1 | 1 |
| 63 | 56 | | | | 1 | 1 | 1 |

FIG. 4

| INPUT GRAY-SCALE LEVEL | DISPLAY GRAY-SCALE LEVEL | SUB-FIELD LUMINANCE WEIGHT | | | | | |
|---|---|---|---|---|---|---|---|
| | | 1 | 2 | 4 | 8 | 16 | 32 |
| 0 | 0 | | | | | | |
| 1 | 1 | 1 | | | | | |
| 2 | 2 | | 1 | | | | |
| 3 | 3 | 1 | 1 | | | | |
| 4 | 4 | | | 1 | | | |
| 5 | 5 | 1 | | 1 | | | |
| 6 | 6 | | 1 | 1 | | | |
| 7 | 7 | 1 | 1 | 1 | | | |
| 8 | 8 | | | | 1 | | |
| 9 | 9 | 1 | | | 1 | | |
| 10 | 10 | | 1 | | 1 | | |
| 11 | 11 | 1 | 1 | | 1 | | |
| 12 | 12 | | | 1 | 1 | | |
| 13 | 13 | 1 | | 1 | 1 | | |
| 14 | 14 | | 1 | 1 | 1 | | |
| 15 | 15 | 1 | 1 | 1 | 1 | | |
| 16 | 17 | 1 | | | | 1 | |
| 17 | 17 | 1 | | | | 1 | |
| 18 | 19 | 1 | 1 | | | 1 | |
| 19 | 19 | 1 | 1 | | | 1 | |
| 20 | 21 | 1 | | 1 | | 1 | |
| 21 | 21 | 1 | | 1 | | 1 | |
| 22 | 23 | 1 | 1 | 1 | | 1 | |
| 23 | 23 | 1 | 1 | 1 | | 1 | |
| 24 | 27 | 1 | 1 | | 1 | 1 | |
| 25 | 27 | 1 | 1 | | 1 | 1 | |
| 26 | 27 | 1 | 1 | | 1 | 1 | |
| 27 | 27 | 1 | 1 | | 1 | 1 | |
| 28 | 31 | 1 | 1 | 1 | 1 | 1 | |
| 29 | 31 | 1 | 1 | 1 | 1 | 1 | |
| 30 | 31 | 1 | 1 | 1 | 1 | 1 | |
| 31 | 31 | 1 | 1 | 1 | 1 | 1 | |
| 32 | 35 | 1 | 1 | | | | 1 |
| 33 | 35 | 1 | 1 | | | | 1 |
| 34 | 35 | 1 | 1 | | | | 1 |
| 35 | 35 | 1 | 1 | | | | 1 |
| 36 | 39 | 1 | 1 | 1 | | | 1 |
| 37 | 39 | 1 | 1 | 1 | | | 1 |
| 38 | 39 | 1 | 1 | 1 | | | 1 |
| 39 | 39 | 1 | 1 | 1 | | | 1 |
| 40 | 47 | 1 | 1 | 1 | 1 | | 1 |
| 41 | 47 | 1 | 1 | 1 | 1 | | 1 |
| 42 | 47 | 1 | 1 | 1 | 1 | | 1 |
| 43 | 47 | 1 | 1 | 1 | 1 | | 1 |
| 44 | 47 | 1 | 1 | 1 | 1 | | 1 |
| 45 | 47 | 1 | 1 | 1 | 1 | | 1 |
| 46 | 47 | 1 | 1 | 1 | 1 | | 1 |
| 47 | 47 | 1 | 1 | 1 | 1 | | 1 |
| 48 | 55 | 1 | 1 | 1 | | 1 | 1 |
| 49 | 55 | 1 | 1 | 1 | | 1 | 1 |
| 50 | 55 | 1 | 1 | 1 | | 1 | 1 |
| 51 | 55 | 1 | 1 | 1 | | 1 | 1 |
| 52 | 55 | 1 | 1 | 1 | | 1 | 1 |
| 53 | 55 | 1 | 1 | 1 | | 1 | 1 |
| 54 | 55 | 1 | 1 | 1 | | 1 | 1 |
| 55 | 55 | 1 | 1 | 1 | | 1 | 1 |
| 56 | 63 | 1 | 1 | 1 | 1 | 1 | 1 |
| 57 | 63 | 1 | 1 | 1 | 1 | 1 | 1 |
| 58 | 63 | 1 | 1 | 1 | 1 | 1 | 1 |
| 59 | 63 | 1 | 1 | 1 | 1 | 1 | 1 |
| 60 | 63 | 1 | 1 | 1 | 1 | 1 | 1 |
| 61 | 63 | 1 | 1 | 1 | 1 | 1 | 1 |
| 62 | 63 | 1 | 1 | 1 | 1 | 1 | 1 |
| 63 | 63 | 1 | 1 | 1 | 1 | 1 | 1 |

FIG. 6

| INPUT GRAY-SCALE LEVEL | DISPLAY GRAY-SCALE LEVEL | SUB-FIELD LUMINANCE WEIGHT | | | | | |
|---|---|---|---|---|---|---|---|
| | | 1 | 2 | 4 | 8 | 16 | 32 |
| 0 | 0 | | | | | | |
| 1 | 1 | 1 | | | | | |
| 2 | 2 | | 1 | | | | |
| 3 | 3 | 1 | 1 | | | | |
| 4 | 4 | | | 1 | | | |
| 5 | 5 | 1 | | 1 | | | |
| 6 | 6 | | 1 | 1 | | | |
| 7 | 7 | 1 | 1 | 1 | | | |
| 8 | 8 | | | | 1 | | |
| 9 | 9 | 1 | | | 1 | | |
| 10 | 10 | | 1 | | 1 | | |
| 11 | 11 | 1 | 1 | | 1 | | |
| 12 | 12 | | | 1 | 1 | | |
| 13 | 13 | 1 | | 1 | 1 | | |
| 14 | 14 | | 1 | 1 | 1 | | |
| 15 | 15 | 1 | 1 | 1 | 1 | | |
| 16 | 16 | | | | | 1 | |
| 17 | 16 | | | | | 1 | |
| 18 | 18 | | 1 | | | 1 | |
| 19 | 18 | | 1 | | | 1 | |
| 20 | 20 | | | 1 | | 1 | |
| 21 | 20 | | | 1 | | 1 | |
| 22 | 22 | | 1 | 1 | | 1 | |
| 23 | 22 | | 1 | 1 | | 1 | |
| 24 | 24 | | | | 1 | 1 | |
| 25 | 24 | | | | 1 | 1 | |
| 26 | 24 | | | | 1 | 1 | |
| 27 | 24 | | | | 1 | 1 | |
| 28 | 28 | | | 1 | 1 | 1 | |
| 29 | 28 | | | 1 | 1 | 1 | |
| 30 | 28 | | | 1 | 1 | 1 | |
| 31 | 28 | | | 1 | 1 | 1 | |
| 32 | 32 | | | | | | 1 |
| 33 | 32 | | | | | | 1 |
| 34 | 32 | | | | | | 1 |
| 35 | 32 | | | | | | 1 |
| 36 | 36 | | | 1 | | | 1 |
| 37 | 36 | | | 1 | | | 1 |
| 38 | 36 | | | 1 | | | 1 |
| 39 | 36 | | | 1 | | | 1 |
| 40 | 40 | | | | 1 | | 1 |
| 41 | 40 | | | | 1 | | 1 |
| 42 | 40 | | | | 1 | | 1 |
| 43 | 40 | | | | 1 | | 1 |
| 44 | 40 | | | | 1 | | 1 |
| 45 | 40 | | | | 1 | | 1 |
| 46 | 40 | | | | 1 | | 1 |
| 47 | 40 | | | | 1 | | 1 |
| 48 | 48 | | | | | 1 | 1 |
| 49 | 48 | | | | | 1 | 1 |
| 50 | 48 | | | | | 1 | 1 |
| 51 | 48 | | | | | 1 | 1 |
| 52 | 48 | | | | | 1 | 1 |
| 53 | 48 | | | | | 1 | 1 |
| 54 | 48 | | | | | 1 | 1 |
| 55 | 48 | | | | | 1 | 1 |
| 56 | 56 | | | | 1 | 1 | 1 |
| 57 | 57 | 1 | | | 1 | 1 | 1 |
| 58 | 58 | | 1 | | 1 | 1 | 1 |
| 59 | 59 | 1 | 1 | | 1 | 1 | 1 |
| 60 | 60 | | | 1 | 1 | 1 | 1 |
| 61 | 61 | 1 | | 1 | 1 | 1 | 1 |
| 62 | 62 | | 1 | 1 | 1 | 1 | 1 |
| 63 | 63 | 1 | 1 | 1 | 1 | 1 | 1 |

FIG. 9

| INPUT (BIT CONTROL PATTERN) | OUTPUT (FROM LOGICAL CONVERSION UNIT 10) |
|---|---|
| MSB LSB | MSB LSB |
| 000 | 000000 |
| 001 | 111110 |
| 011 | 111100 |
| 111 | 111000 |

FIG. 12

| | LINE EVEN/ODD | FIELD EVEN/ODD | SELECTED INPUT |
|---|---|---|---|
| $\lvert a-b \rvert > TH$ | × | × | a |
| $\lvert a-b \rvert < TH$ | 0 | 0 | a |
| $\lvert a-b \rvert < TH$ | 1 | 0 | b |
| $\lvert a-b \rvert < TH$ | 0 | 1 | b |
| $\lvert a-b \rvert < TH$ | 1 | 1 | a |

FIG. 15

| | LINE EVEN/ODD | FIELD EVEN/ODD | SELECTED INPUT |
|---|---|---|---|
| $\lvert a-b \rvert > TH1$ | × | × | a |
| $\lvert a-b \rvert < TH1$ | 0 | 0 | c |
| $\lvert a-b \rvert < TH1$ | 1 | 0 | b |
| $\lvert a-b \rvert < TH1$ | 0 | 1 | b |
| $\lvert a-b \rvert < TH1$ | 1 | 1 | c |

FIG. 17

| CHECKERED PATTERN LEVEL DIFFERENCE | CHECKERED PATTERN | PIXEL H/L | SELECTED INPUT |
|---|---|---|---|
| SMALL | YES | × | a |
| GREAT | YES | H | b |
| SMALL | NO | × | d |
| GREAT | NO | × | d |
| SMALL | YES | × | a |
| GREAT | YES | L | c |
| SMALL | NO | × | d |
| GREAT | NO | × | d |

FIG. 20

| DISPLAY LUMINANCE VALUE | 1 | 2 | 3 | 4 | 5 | 6 | 7 | 8 | 9 | 10 | 11 | 12 | SUB-FIELD NUMBER |
|---|---|---|---|---|---|---|---|---|---|---|---|---|---|
| | 1 | 2 | 4 | 8 | 16 | 24 | 32 | 32 | 32 | 32 | 32 | 32 | SUB-FIELD LUMINANCE WEIGHT |
| 0 | 0 | 0 | 0 | 0 | 0 | 0 | 0 | 0 | 0 | 0 | 0 | 0 | |
| 63 | 1 | 1 | 1 | 0 | 0 | 1 | 1 | 0 | 0 | 0 | 0 | 0 | |
| 60 | 0 | 0 | 1 | 0 | 0 | 1 | 1 | 0 | 0 | 0 | 0 | 0 | |
| 4 | 0 | 0 | 1 | 0 | 0 | 0 | 0 | 0 | 0 | 0 | 0 | 0 | |
| 48 | 0 | 0 | 0 | 1 | 1 | 1 | 0 | 0 | 0 | 0 | 0 | 0 | |
| 15 | 1 | 1 | 1 | 1 | 0 | 0 | 0 | 0 | 0 | 0 | 0 | 0 | |
| 52 | 0 | 0 | 1 | 1 | 1 | 1 | 1 | 0 | 0 | 0 | 0 | 0 | |
| 12 | 0 | 0 | 1 | 1 | 0 | 0 | 0 | 0 | 0 | 0 | 0 | 0 | |
| 32 | 0 | 0 | 0 | 1 | 0 | 1 | 0 | 0 | 0 | 0 | 0 | 0 | |
| 2 | 0 | 1 | 0 | 0 | 0 | 0 | 0 | 0 | 0 | 0 | 0 | 0 | |
| 33 | 1 | 0 | 0 | 1 | 0 | 1 | 0 | 0 | 0 | 0 | 0 | 0 | |
| 1 | 1 | 0 | 0 | 0 | 0 | 0 | 0 | 0 | 0 | 0 | 0 | 0 | |

FIG. 21

INPUT CHECKERED PATTERN

| LEVEL H | LEVEL L | AVERAGE |
|---|---|---|
| 63 | 0 | 31.5 |

| LOWER BIT PATTERN | LEVEL H | LEVEL L | AVERAGE | DIFFERENCE |
|---|---|---|---|---|
| 000 | 56 | 0 | 28 | −3.5 |
| 100 | 57 | 1 | 29 | −2.5 |
| 010 | 58 | 2 | 30 | −1.5 |
| 110 | 59 | 3 | 31 | −0.5 |
| 001 | 60 | 4 | 32 | 0.5 |
| 101 | 61 | 5 | 33 | 1.5 |
| 011 | 62 | 6 | 34 | 2.5 |
| 111 | 63 | 7 | 35 | 3.5 |

LSB MSB

REPLACING CHECKERED PATTERN

| LEVEL H' | LEVEL L' | AVERAGE |
|---|---|---|
| 60 | 4 | 32 |

FIG. 22

INPUT CHECKERED PATTERN

| LEVEL H | LEVEL L | AVERAGE |
|---|---|---|
| 48 | 15 | 31.5 |

| LOWER BIT PATTERN | LEVEL H | LEVEL L | AVERAGE | DIFFERENCE |
|---|---|---|---|---|
| 000 | 48 | 8 | 28 | −3.5 |
| 100 | 49 | 9 | 29 | −2.5 |
| 010 | 50 | 10 | 30 | −1.5 |
| 110 | 51 | 11 | 31 | −0.5 |
| 001 | 52 | 12 | 32 | 0.5 |
| 101 | 53 | 13 | 33 | 1.5 |
| 011 | 54 | 14 | 34 | 2.5 |
| 111 | 55 | 15 | 35 | 3.5 |

LSB MSB

REPLACING CHECKERED PATTERN

| LEVEL H' | LEVEL L' | AVERAGE |
|---|---|---|
| 52 | 12 | 32 |

FIG. 23

INPUT CHECKERED PATTERN

| LEVEL H | LEVEL L | AVERAGE |
|---|---|---|
| 32 | 2 | 17 |

| LOWER BIT PATTERN | LEVEL H | LEVEL L | AVERAGE | DIFFERENCE |
|---|---|---|---|---|
| 000 | 32 | 0 | 16 | −1 |
| 100 | 33 | 1 | 17 | 0 |
| 010 | 34 | 2 | 18 | 1 |
| 110 | 35 | 3 | 19 | 2 |
| 001 | 36 | 4 | 20 | 3 |
| 101 | 37 | 5 | 21 | 4 |
| 011 | 38 | 6 | 22 | 5 |
| 111 | 39 | 7 | 23 | 6 |

LSB MSB

REPLACING CHECKERED PATTERN

| LEVEL H' | LEVEL L' | AVERAGE |
|---|---|---|
| 33 | 1 | 17 |

PRIOR ART

FIG. 24

| INPUT GRAY-SCALE LEVEL | DISPLAY GRAY-SCALE LEVEL | SUB-FIELD LUMINANCE WEIGHT | | | | | |
|---|---|---|---|---|---|---|---|
| | | 1 | 2 | 4 | 8 | 16 | 32 |
| 0 | 0 | | | | | | |
| 1 | 1 | 1 | | | | | |
| 2 | 2 | | 1 | | | | |
| 3 | 3 | 1 | 1 | | | | |
| 4 | 4 | | | 1 | | | |
| 5 | 5 | 1 | | 1 | | | |
| 6 | 6 | | 1 | 1 | | | |
| 7 | 7 | 1 | 1 | 1 | | | |
| 8 | 8 | | | | 1 | | |
| 9 | 9 | 1 | | | 1 | | |
| 10 | 10 | | 1 | | 1 | | |
| 11 | 11 | 1 | 1 | | 1 | | |
| 12 | 12 | | | 1 | 1 | | |
| 13 | 13 | 1 | | 1 | 1 | | |
| 14 | 14 | | 1 | 1 | 1 | | |
| 15 | 15 | 1 | 1 | 1 | 1 | | |
| 16 | 16 | | | | | 1 | |
| 17 | 17 | 1 | | | | 1 | |
| 18 | 18 | | 1 | | | 1 | |
| 19 | 19 | 1 | 1 | | | 1 | |
| 20 | 20 | | | 1 | | 1 | |
| 21 | 21 | 1 | | 1 | | 1 | |
| 22 | 22 | | 1 | 1 | | 1 | |
| 23 | 23 | 1 | 1 | 1 | | 1 | |
| 24 | 24 | | | | 1 | 1 | |
| 25 | 25 | 1 | | | 1 | 1 | |
| 26 | 26 | | 1 | | 1 | 1 | |
| 27 | 27 | 1 | 1 | | 1 | 1 | |
| 28 | 28 | | | 1 | 1 | 1 | |
| 29 | 29 | 1 | | 1 | 1 | 1 | |
| 30 | 30 | | 1 | 1 | 1 | 1 | |
| 31 | 31 | 1 | 1 | 1 | 1 | 1 | |
| 32 | 32 | | | | | | 1 |
| 33 | 33 | 1 | | | | | 1 |
| 34 | 34 | | 1 | | | | 1 |
| 35 | 35 | 1 | 1 | | | | 1 |
| 36 | 36 | | | 1 | | | 1 |
| 37 | 37 | 1 | | 1 | | | 1 |
| 38 | 38 | | 1 | 1 | | | 1 |
| 39 | 39 | 1 | 1 | 1 | | | 1 |
| 40 | 40 | | | | 1 | | 1 |
| 41 | 41 | 1 | | | 1 | | 1 |
| 42 | 42 | | 1 | | 1 | | 1 |
| 43 | 43 | 1 | 1 | | 1 | | 1 |
| 44 | 44 | | | 1 | 1 | | 1 |
| 45 | 45 | 1 | | 1 | 1 | | 1 |
| 46 | 46 | | 1 | 1 | 1 | | 1 |
| 47 | 47 | 1 | 1 | 1 | 1 | | 1 |
| 48 | 48 | | | | | 1 | 1 |
| 49 | 49 | 1 | | | | 1 | 1 |
| 50 | 50 | | 1 | | | 1 | 1 |
| 51 | 51 | 1 | 1 | | | 1 | 1 |
| 52 | 52 | | | 1 | | 1 | 1 |
| 53 | 53 | 1 | | 1 | | 1 | 1 |
| 54 | 54 | | 1 | 1 | | 1 | 1 |
| 55 | 55 | 1 | 1 | 1 | | 1 | 1 |
| 56 | 56 | | | | 1 | 1 | 1 |
| 57 | 57 | 1 | | | 1 | 1 | 1 |
| 58 | 58 | | 1 | | 1 | 1 | 1 |
| 59 | 59 | 1 | 1 | | 1 | 1 | 1 |
| 60 | 60 | | | 1 | 1 | 1 | 1 |
| 61 | 61 | 1 | | 1 | 1 | 1 | 1 |
| 62 | 62 | | 1 | 1 | 1 | 1 | 1 |
| 63 | 63 | 1 | 1 | 1 | 1 | 1 | 1 |

IMAGE DISPLAY APPARATUS FOR WRITING DISPLAY INFORMATION WITH REDUCED ELECTRIC CONSUMPTION

RELATED APPLICATIONS

This is a divisional application of U.S. Ser. No. 09/929,946, filed on Aug. 15, 2001.

BACKGROUND OF THE INVENTION (1) Field of the Invention

The present invention relates to a display apparatus such as a plasma display. More particularly, the present invention relates to an image display apparatus for writing display information with reduced power consumption.

(2) Description of the Related Art

Typically, when a display apparatus such as a plasma display which displays images based on a two-value display method is used to display images, the display apparatus displays gray-scale images by dividing one field in the time domain into a plurality of sub-fields to which luminance weights are assigned, and controlling ON/OFF of light emission for each sub-field. For example, to display images with 256 gray-scale levels, one field is divided into 8 sub-fields, and assigns luminance weights "1", "2", "4", "8", "16", "32", "64", and "128" to the 8 sub-fields in the order of time. The display apparatus receives an input digital signal that contains a set of 8 bits that correspond to the above sequence of sub-fields, in the reversed order of the bit sequence (i.e., the lowest bit corresponds to the lowest luminance weight).

FIG. 24 shows relationships between input gray-scale levels contained the input image signals and display gray-scale levels, and the luminance weights assigned to the sub-fields. FIG. 25 is a plot, based on the data shown in FIG. 24, of display gray-scale levels on the vertical axis vs. input gray-scale levels on the horizontal axis. The sub-field information shown in the drawings is written into display cells as the display information by applying voltage to the display cells via the address electrode.

The address electrodes have capacitances for other driving electrodes. Capacitances are also disposed between adjacent address electrodes. When the voltage waveform of the voltage applied to the address electrode changes greatly, a great amount of power is consumed for charging or discharging the capacitances. The amount of power consumed in the address driver also increases as the number of pixels to be displayed on the display apparatus increases, or as the driving voltage required for the addressing increases.

As a solution to the above problems, Japanese Laid-Open Patent Application No. 10-187093 discloses a technique that is equivalent to the one shown in FIG. 26. This technique intends to reduce the amount of power consumed in the address driver by shifting the timing of the driving waveform, removing the high-frequency component from the spatial frequency component of the input signal in accordance with the expected values of the amount of power consumed in the data driver, or omitting to display lower bits of the display signal in accordance with the expected values of power consumption amount.

Japanese Laid-Open Patent Application No. 2000-66638 (P2000-66638A) discloses a technique that intends to reduce the gray-scale levels of display images using a method in which data for sub-fields with smaller luminance weights is prevented from being written or changed, in accordance with the expected values of amount lost in the driver that are obtained from the display data changing patterns.

However, the conventional method of shifting the timing of the address driving waveform have a defect that it needs to secure a time for shifting the address driving waveform, and as a result, needs to lengthen the period of the address driving waveform. That is to say, the time required for the address driving over the whole period of one field is proportionate to the number of lines on the display apparatus. The time required for the address driving occupies relatively a large portion of the field, cycle. As a result, if the time required for the address driving increases slightly, the time that can be used for light emission greatly decreases. This makes it difficult to maintain the luminance.

The other method of restricting the number of display bits or display gray-scale levels in accordance with the expected values of power consumption amount also has a defect that to accurately expect the amount of heat generated in the driving device, it is required to add up a great amount of image information in the time and space domain. This increases the scale of circuits such as a memory device.

When, as is the case with the above conventional technique, the number of bits for the display image is changed only in accordance with the expected values of power consumption amount, the reduction of the number of bits or gray-scale levels may be noticed as image deterioration depending on the display images. This method also has a problem that a certain pattern in the whole image may be displayed as a different image depending on the position of the pattern in the whole image or depending on a combination with another pattern, or that an image that should move smoothly in time may move discontinuously. These phenomena allow viewers to feel unnaturalness.

SUMMARY OF THE INVENTION

The object of the present invention accordingly is to provide an image display apparatus that is practical and effective in reducing the power consumption when image display information is written.

The above object is fulfilled by an image display apparatus for displaying gray-scale images by writing display information to an image display area of a panel, the display information including values of a plurality of sub-fields constituting a field, the image display apparatus being characterized by converting an input image signal into a piece of display information so that a difference between sub-fields in correspondence with each other in adjacent high gray-scale levels becomes less, and displaying a gray-scale image in accordance with the piece of display information.

With the above-described construction, in the display information converted from the input image signal, high gray-scale levels, which have high luminance weights, may have common sub-field values. When this happens, even if gray-scale levels in a certain range in input image signals change frequently, the frequency of change in the waveform of voltage applied to the address electrode decreases. This reduces power consumption in the address driver.

The low luminance levels in input image signals may be faithfully reflected in the display information. In general, low luminance part of an image can be reproduced by turning ON a small number of sub-fields, and writing a small number of sub-fields into the panel. This allows the driver to consume a little amount of power. As a result, even if low luminance levels in input image signals are reflected faithfully in the display information, the amount of power consumed in the address driver does not change much.

On the contrary, in general, high-luminance part of an image is reproduced by switching between ON and OFF a large number of sub-fields. The high luminance part therefore has a high probability that the amount of power consumed in the address driver increases. As a result, the effect of restricting the power consumption in the address driver is expected more by allowing the higher-luminance part to have a more amount of common writing information.

In the above-stated construction, even if the input image signal is converted so that high gray-scale levels have lower sub-field values in common, the difference generated by this is relatively small. As a result, if the number of gray-scale levels is restricted in this way, viewers do not recognize it as an image quality degradation. The image display apparatus, therefore, can display images with the luminance ranging from low to high levels, without allowing the viewers to notice an image quality degradation.

In the above image display apparatus, the conversion of the input image signal may be performed so that as a gray-scale level in the input image signal increases, the number of sub-field values that are common with an adjacent gray-scale level increases.

In the above image display apparatus, the conversion of the input image signal may be performed so that as a gray-scale level in the input image signal increases, the number of large steps increases, where each step is a gap between the gray-scale level in the input image signal and corresponding gray-scale levels in the display information.

In the above image display apparatus, the conversion of the input image signal may be performed so that bit values of sub-fields to which small luminance weights are assigned become either "0" or "1".

With the above construction, the input image signal is converted so that as a gay-scale level in the input image signal increases, the number of sub-fields with fixed small luminance weights increases. This restricts the power consumption in the address driver when displaying a high-luminance image.

As for a low-luminance part of an image, since the original minute differences between gay-scale levels are maintained, the minute gray-scale levels of the original image are reproduced. In general, low-luminance part of an image consumes little amount of power.

Accordingly, the above-stated construction provides a high-quality image display for a wide range of gay-scale levels ranging from low luminance to high luminance, while reducing the power consumption in the address driver. The above object is also fulfilled by an image display apparatus for displaying gay-scale images by representing each gay-scale level of the images by an ON/OFF pattern of a set of sub-fields constituting one field, the image display apparatus being characterized by converting an input image signal into a piece of display information so that as a gay-scale level in the input image signal increases, the number of serial sub-fields that are all ON or all OFF and are common with an adjacent gay-scale level increases.

With the above construction, it is possible to, for example, write fixed information so that for high gray-scale levels, sub-fields with low luminance weights are all turned ON or all turned OFF. This enables the amount of power consumed in the address driver to be restricted when high gray-scale level part, or high luminance part is displayed. It is also possible with this construction to convert the input image signals so as to reduce the number of sub-fields that are turned OFF commonly between adjacent gray-scale levels in a certain range of highest gray-scale levels. This enables images to be displayed without reduction of peak luminance while reducing the address power as a whole.

The above object is also fulfilled by an image display apparatus for displaying gray-scale images by representing each gray-scale level of the images by an ON/OFF pattern of a set of sub-fields constituting one field, characterized in that (N−M) higher bits of an N-bit input digital image signal are a first signal, lower M bits of the N-bit input digital image signal are a second signal, where M and N are integers satisfying a condition $0 \leqq M \leqq N$, a calculation using the second signal as an input and including a plurality of delays is performed to obtain a signal, lower M bits of the obtained signal are all changed to "0" to generate a third signal, and a signal obtained by adding the third signal to the first signal represents a display gray-scale level.

The above object is also fulfilled by an image display apparatus for displaying gray-scale images by representing each gray-scale level of the images by an ON/OFF pattern of a set of sub-fields constituting one field, characterized in that (N−M) higher bits of an N-bit input digital image signal are a temporary display gray-scale level, where M and N are integers satisfying a condition $M \leqq N$, and an actual display is performed by correcting an error between the N-bit input digital image signal and the temporary display gray-scale level, using an error diffusion method that forms a circular loop by an M-bit line memory.

The above object is also fulfilled by an image display apparatus comprising: means for displaying gray-scale images by representing each gray-scale level of the images by an ON/OFF pattern of a set of sub-fields constituting one field; and means for subjecting an N-bit input digital image signal to an error diffusion process to reduce the number of display bits and displaying the resultant signal, wherein as a gray-scale level in the N-bit input digital image signal increases, the number of display bits to be reduced increases in units of display pixels.

With the above construction, it is possible to respond at high speed to each gray-scale level of pixel in input image signals, calculate the number of effective display bits, and assign different numbers of effective display bits to a low-luminance part and a high-luminance part. As a result of this, the high-luminance part is displayed while the change of the driving waveform supplied to the address electrode is restricted and the amount of power consumed in the address driver is reduced, and the low-luminance part, which allows the address driver to consume little amount of power, is displayed with the original luminance. It should be noted here that "lower bits" correspond to part of a set of sub-fields, and that smaller luminance weights are assigned to the lower bits.

Also, in the above construction, even for the high-luminance part where the number of effective bits is reduced, an error between the gray-scale level of the input image signal and the actually displayed gray-scale level is diffused to the periphery. This provides visually sufficient display gray-scale levels. Different from a conventional error diffusion method in which the number of effective display bits is fixed, the image display apparatus of the present invention adds display errors accumulated from peripheral pixels to a focused pixel to the display data by the number of bits that is determined from the gray-scale level of the focused pixel, and at the same time, diffuses newly generated display errors from the focused pixel to peripheral pixels in accordance with the display bits of the focused pixel. This allows the number of effective bit-width to change for each pixel and achieves visually sufficient display gray-scale levels ranging from low to high luminance levels.

In the above image display apparatus, the display gray-scale level may be obtained by adding a signal having an amplitude corresponding to a gray-scale level to the input image signal, either with regular periods or with irregular periods.

In the above image display apparatus, the signal that is added with regular periods may be a signal that is inverted in units of pixels, lines, or fields.

In the above image display apparatus, the signal that is added with irregular periods may be a signal that is inverted at random in units of pixels, lines, or fields.

With the above construction, it is possible to restrict the number of gray-scale levels that are actually used when an image is displayed, and is possible to display the image by increasing the number of gray-scale levels that are visually equal to each other, using the error diffusion method, while preventing a certain image pattern from being recognized by a viewer.

In the above image display apparatus, a display error may be diffused to a peripheral of a focused pixel using the error diffusion method.

With the above construction, it is possible to improve the image quality using a known means for improving the image quality.

The above object is also fulfilled by an image display apparatus for displaying gray-scale images by representing each gray-scale level of the images by an ON/OFF pattern of a set of sub-fields constituting a field in the time domain, characterized in that an area composed of a plurality of adjacent pixels is set in response to an input image signal, then a plurality of pieces of display information having, in common, sub-fields with a same pattern between adjacent pixels are generated, and the gray-scale images are displayed in accordance with the plurality of pieces of display information.

With the above construction, it is possible to generate the display information in accordance with a rule set for a certain range of gray-scale levels in the input image signals, and restrict the amount of power consumed when data is written, by allowing adjacent pixels to have common sub-field values. It is important especially that the writing information is generated not in accordance with a certain rule for the whole screen, but in accordance with the rule set for a certain range of gray-scale levels in the input image signals. This enables the display information to be generated so as to increase the effect of reducing the amount of writing power consumed in the address driver, while restricting the image quality degradation.

In the above image display apparatus, a piece of display information corresponding to the smallest change of an average gray-scale level in the area maybe selectively used.

With the above construction, in addition to the effect of restricting the amount of power consumed when data is written, by allowing adjacent pixels to have common sub-field values, it is possible to prevent an image quality change from being noticed, by restricting the change of the average luminance value due to replacement of writing information and restricting the change of luminance and color tone.

In the above image display apparatus, a standard pixel may be set in the area, and gray-scale levels of pixels excluding at least the standard pixel in the area are changed so that the plurality of pieces of display information have, in common, sub-fields having a same pattern between adjacent pixels.

With the above construction, it is possible to restrict signal change between the standard pixel and the other pixels and reduce the amount of power consumed in the address driver, while maintaining the original value of the standard pixel. This prevents the image information from noticeably changing and restricts the image quality degradation.

In the above image display apparatus, a standard pixel may be set in the area, and when a difference between a gray-scale level of a pixel in the area and that of the standard pixel is lower than a value that is determined in accordance with a gray-scale level of the standard pixel. indicated in an input image signal, the gray-scale level of the pixel in the area and the gray-scale level of the standard pixel are adjusted to be equal to each other.

With the above construction, pixels with luminance levels being little different from the luminance of the standard pixel are each replaced with the same signal as that of the standard pixel. This replacement does not cause a viewer to recognize an image quality degradation. Since the signal of the standard pixel completely matches the signal of each of the peripheral pixels, the change between signals of the standard pixel and the peripheral pixels is eliminated. This reduces the amount of writing power consumed in the address driver.

In the above image display apparatus, the sub-fields commonly contained in the plurality of pieces of display information may be lower sub-fields among all sub-fields.

With the above construction, adjacent pixels have common lower sub-field values with low luminance. This restricts the amount of power consumed in the address driver when data is written, and also prevents the image quality from deteriorating greatly.

In the above image display apparatus, the area may be composed of two adjacent lines.

With the above construction, the signals in the area have a value in common. However, this arrangement does not cause the image quality to deteriorate greatly since the lines in a pair inherently show a strong correlation with each other. Accordingly, this restricts the amount of power consumed in the address driver when data is written.

In the above image display apparatus, the area changes regularly or irregularly in units of pixels.

With the above construction, in the case of an area that changes regularly in units of pixels (e.g., an area representing a title pattern such as a checkered pattern), it is possible to restrict the frequency of signal change between adjacent pixels while attaching importance to the average luminance or color tone of the entire pattern area rather than to the gray-scale level of each pixel constituting the pattern. This restricts the amount of power consumed in the address driver when data is written, while restricting the image quality degradation. In the case of an area that changes irregularly in units of pixels, representing details of a complicated image such as "hair" or "texture" and tending to be recognized by a viewer as an image quality degradation when the high-frequency component is removed from the spatial, frequency component, it is possible to allow a plurality of sub-fields to have a common value while maintaining the contrast between each pixel of the original image. This restricts the amount of power consumed in the address driver when data is written, and also prevents the image quality from deteriorating greatly.

The above object is also fulfilled by an image display apparatus for displaying gray-scale images by representing each gray-scale level of the images by an ON/OFF pattern of a set of sub-fields constituting a field in the time domain, characterized in that an area composed of a plurality of adjacent pixels is set in response to an input image signal, then a signal level of the area is changed, and a luminance difference between main gray-scale levels in the area is changed to be no less than a certain value that is determined in accordance with the luminance difference between the main gray-scale levels.

With the above construction, it is possible to restrict the signal change between pixels and restrict the amount of power consumed in the address driver when data is written, while maintaining the contrast of the image.

In the above image display apparatus, the main gray-scale levels in the area may form a regular pattern in units of pixels (for example, a checkered pattern).

In the above image display apparatus, the main gray-scale levels in the area may be two or less gray-scale levels for each display color, and form a regular pattern in units of pixels for each display color. More particularly, the pattern may be a checkered pattern or a tile pattern, for example.

The above object is also fulfilled by an image display apparatus for displaying gray-scale images by representing each gray-scale level of the images by an ON/OFF pattern of a set of sub-fields constituting a field in the time domain, characterized in that an area composed of a plurality of adjacent pixels is set in response to an input image signal, a standard pixel is set in the area, then gray-scale levels of pixels excluding at least the standard pixel in the area are changed so that the number of sub-fields that are different between the standard pixel and pixels adjacent to the standard pixel is restricted, and so that a luminance difference between main gray-scale levels in the area is changed to be no less than a certain value that is determined in accordance with the luminance difference between the main gray-scale levels.

With the above construction, it is possible to restrict the signal change between pixels and restrict the amount of power consumed in the address driver when data is written, while maintaining the contrast of the image.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 2 shows relationships between input gray-scale levels and display gray-scale levels;

FIG. 4 shows relationships between input gray-scale levels and display gray-scale levels in the plasma display PD2 in Embodiment 2 of the present invention;

FIG. 6 shows relationships between input gray-scale levels and display gray-scale levels in the plasma display PD3 in Embodiment 3 of the present invention;

FIG. 9 shows truth values resulting from operation examples performed by a logical conversion unit 10 shown in FIG. 8;

FIG. 12 is a table showing how the selection unit 34 performs a selection;

FIG. 15 is a table showing how the selection unit 41 performs a selection;

FIG. 17 shows how the level conversion unit 48 operates;

FIG. 20 shows a detailed operation of the level conversion unit in Embodiment 7;

FIG. 21 shows a detailed operation of the level conversion unit in Embodiment 7;

FIG. 22 shows a detailed operation of the level conversion unit in Embodiment 7;

FIG. 23 shows a detailed operation of the level conversion unit in Embodiment 7;

FIG. 24 shows relationships between input gray-scale levels and display gray-scale levels in the plasma display PD2 in a conventional example;

DESCRIPTION OF THE PREFERRED EMBODIMENT

The following describes embodiments of the present invention with reference to the attached drawings.

Embodiment 1

Figure 1:
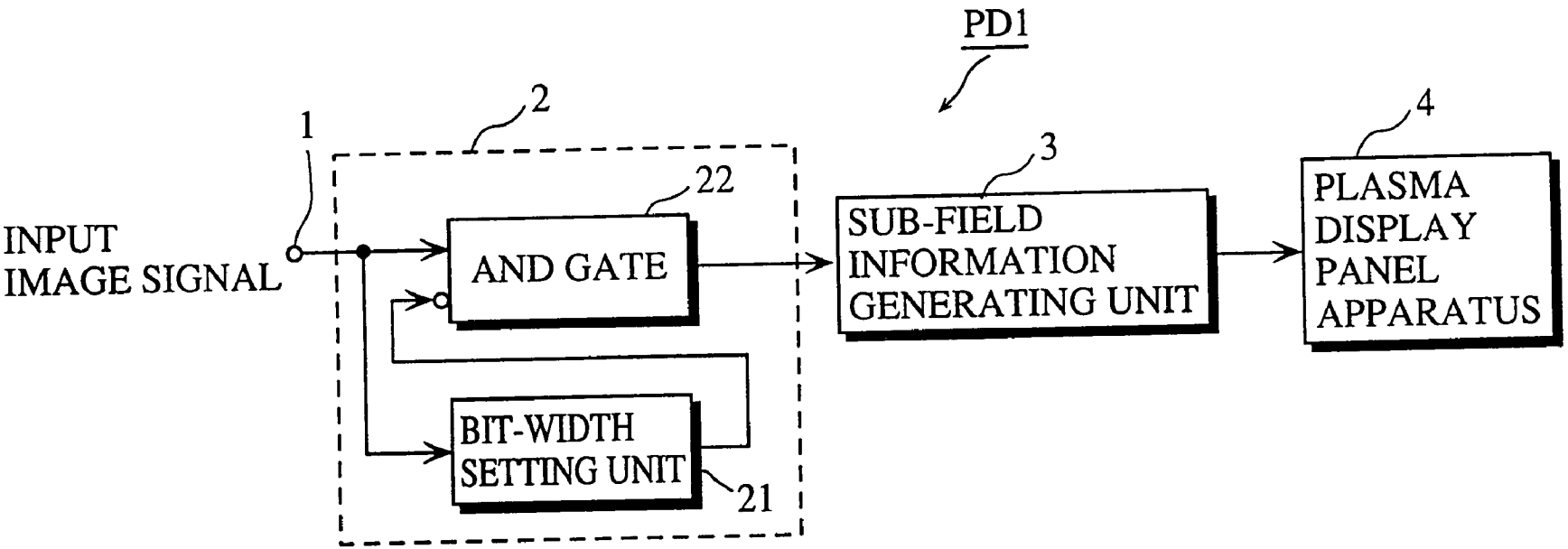
FIG. 1 is a block diagram showing the construction of a plasma display PD1 in Embodiment 1 of the present invention that displays gray-scale images using sub-fields.

FIG. 1 is a block diagram showing the construction of a plasma display PD1 that displays gray-scale images using sub-fields.

As shown in FIG. 1, the plasma display PD1 includes an input image signal conversion unit 2, a sub-field information generating unit 3, and a plasma display panel apparatus 4.

The input image signal conversion unit 2 includes a bit-width setting unit 21 and an AND gate 22.

The sub-field information generating unit 3 converts an image signal supplied from the input image signal conversion unit 2 into pieces of ON/OFF information (i.e., sub-field information). Here, the input image signal contains a variety of gray-scale levels for pixels constituting an image to be displayed on a screen. Each piece of ON/OFF information or sub-field information indicates an ON/OFF combination of a set of sub-fields corresponding to one of the gray-scale levels. Each sub-field is assigned with a luminance weight beforehand. The light emission is kept with a luminance corresponding to the luminance weight so that the summation of the amounts of light emitted by a set of sub-fields represents a corresponding gray-scale level.

The sub-field information generated by the sub-field information generating unit 3 is written to a panel unit in the plasma display panel apparatus 4 via an address driver, then the light emission for each pixel is kept. This is what is called sub-field time-division gray-scale display method. The plasma display PD1 displays gray-scale images using this method.

The following is a detailed description of the operation of the plasma display PD1, together with an explanation of the function of each component.

In the present embodiment, each gray-scale level is represented by a piece of sub-field information composed of 6 bits. The six bits are arranged in the order, from left to right, from the highest bit to the lowest bit, where the largest weight is assigned to the highest bit and the smallest weight is assigned to the lowest bit. The bit-width setting unit 21 and the AND gate 22 cooperate to calculate effective bit widths for each gray-scale level contained in an input image signal 1. For this purpose, the bit-width setting unit 21 first sets a modification bit width for each gray-scale level, where the modification bit width indicates a series of bits that are to be modified in the present embodiment, in each set of bits representing a gray-scale level. It should be noted here that the "effective bit width" indicates a series of bits contained in the received image signal that can be used as the display information as it is. Also, the input image signal is a digital signal that contains a plurality of sets of certain number of bits (e.g., 6 bits), each set representing a gray-scale level of a pixel that constitutes a display image.

The basic method for determining the effective bit width is as follows. For every low gray-scale level, the bit width over the whole span of bits (e.g., 6 bits) as received is determined as the effective bit width. For the other higher gray-scale levels, as the gray-scale level becomes higher, the ratio of the effective bit width to the entire bit width decreases. In other words, as the gray-scale level increases, the modification bit width set by the bit-width setting unit 21 becomes longer.

The AND gate 22 performs a certain calculation so that the lower bits corresponding to the modification bit width are fixed to "0", which is done in the present embodiment intentionally. Here, the darker part of the display image is represented by lower gray-scale levels. As a result, the bit values contained in the input image signal 1 representing the darker part of the image are used as they are. The following is a description of the operation for each pixel.

Suppose that an input image signal with gray-scale level "50" is received, for example. In correspondence with this, the sub-field information generating unit 3 generates sub-field information "110010" that shows the ON/OFF combination of the six sub-fields, where in this example of the present embodiment, luminance weights "1", "2", "4", "8", "16", and "32" are assigned to the six bits in the reversed order of the bit sequence. That is to say, as described earlier, the six bits are arranged in the order, from left to right, from the highest bit to the lowest bit, where the largest weight is assigned to the highest bit and the smallest weight is assigned to the lowest bit. Here, suppose that the bit-width setting unit 21 sets the modification bit width as the lower 2 bits "10", then the AND gate 22 outputs "110000" as the display information, with the higher 2 bits "11" as the effective bit width. As a result of this, the two lower bits are fixed to "0".

The AND gate 22 performs a logical operation for each bit, and outputs the results as a serial signal composed of a certain number of bits (e.g., 6 bits). This applies to all the embodiments described in the present document. It should be noted here that a component (not illustrated) is disposed before the AND gate 22, the component storing relationships between the image signal held by the sub-field information generating unit 3 and the ON/OFF combination of the sub-fields. This also applies to Embodiments 2 to 4.

Figure 3:
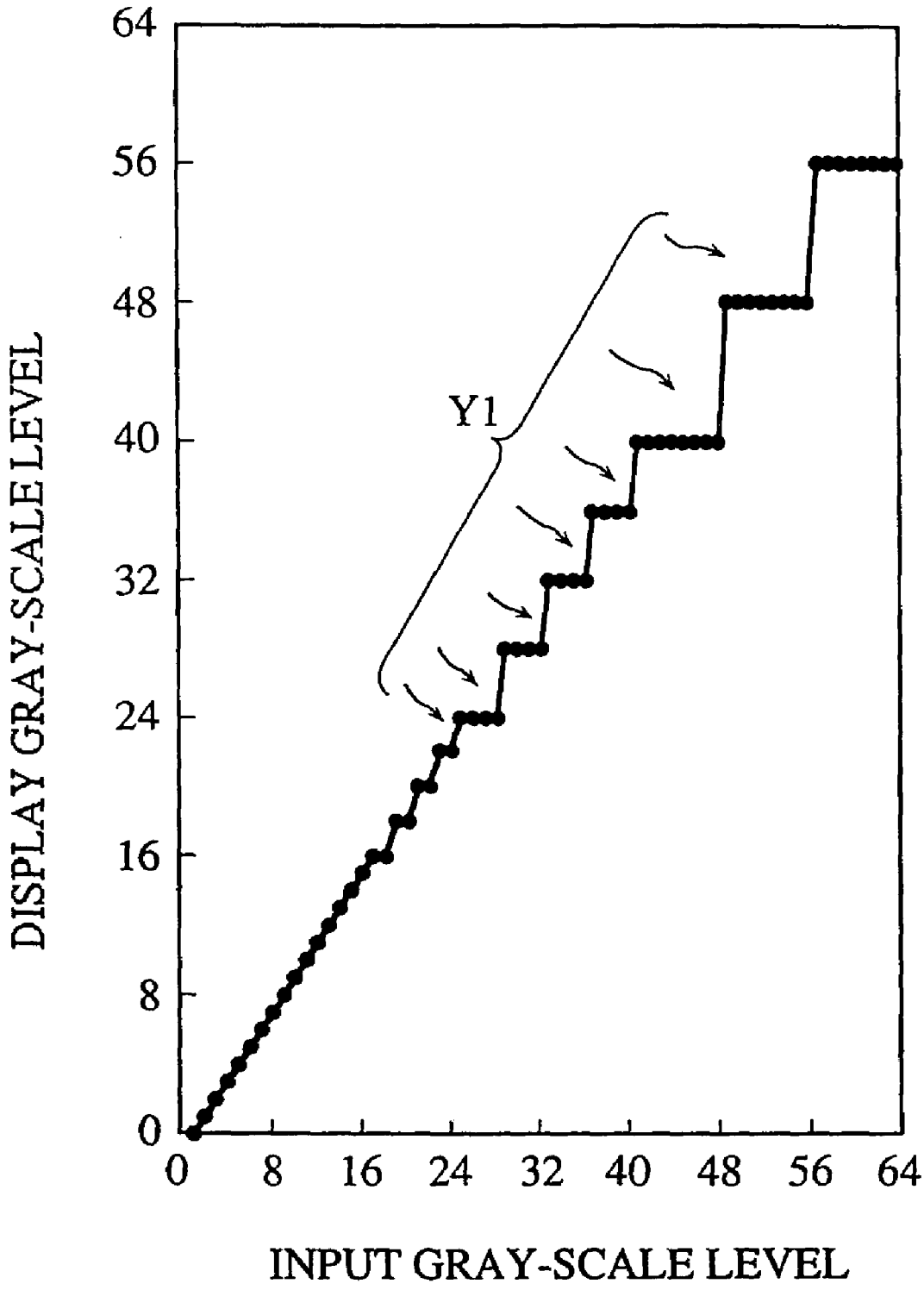
FIG. 3 is a plot of display gray-scale levels on the vertical axis vs. input gray-scale levels on the horizontal axis.

FIG. 2 shows relationships between gray-scale levels contained in the input image signals and grayscale levels used for displayed images. In other words, FIG. 2 shows relationships between inputs and outputs of the input image signal conversion unit 2 shown in FIG. 1. FIG. 3 is a plot of display gray-scale levels on the vertical axis vs. input gray-scale levels on the horizontal axis.

FIG. 2 indicates that, for example, when an image signal with a gray-scale level "10" (the sub-field information for this input value is "001010") is input, the output gray-scale level is also "10" (the sub-field information for this output value is also "001010"). That is to say, since the input gray-scale level "10" has a low luminance, the bit-width setting unit 21 sets such a modification bit width as allows the AND gate 22 to output the same sub-field information values as those for the input image signal. That is, the entire bit width as received is determined as the effective bit width.

On the other hand, when an image signal with a gray-scale level "50" (the sub-field information for this input value is "110010") is input, the output gray-scale level is "48" (the sub-field information for this output. value is "110000"). That is to say, since the input gray-scale level "50" has a high luminance, the bit-width setting unit 21 sets such a modification bit width as allows the AND gate 22 to output sub-field information values whose lower bits are fixed to "0", with less effective bits "1" than the input image signal.

As understood the above examples based on FIGS. 2 and 3, the bit-width setting unit 21 sets modification bit widths in a manner that for darker parts of images, the bit width of the input image signal 1 is used as the effective bit width as it is; and as the gray-scale level increases, the modification bit width becomes longer, with the lower bits being fixed to "0" intentionally. With such an operation, as the input gray-scale level increases, large "steps" (the leaping steps shown in FIG. 3, indicated by arrows Y1) are generated, each step being formed by the gap between the input and output gray-scale levels. This is confirmed by referring to FIG. 2. In a box encircled by a dotted line, which corresponds to higher gray scale levels, it is found that sub-fields with small luminance weights in the output sub-field information are fixed to "0".

As described above, as the gray-scale level becomes higher, the ratio of the effective bit width to the entire bit width decreases. With this arrangement, the driving waveform of the address electrode does not change at least over a series of adjacent input pixel values (gray-scale levels). As a result of this, the driving waveform changes less over a whole field, which reduces the power consumption of the address driver.

As described above, as the gray-scale level becomes higher, the ratio of the effective bit width to the entire bit width decreases. With this arrangement, the driving waveform of the address electrode does not change at least over a series of adjacent input pixel values (gray-scale levels). As a result of this, the driving waveform changes less over a whole field, which reduces the electric consumption of the address driver.

It is noticed that as the gray-scale level increases, large display "steps", or a discontinuity of gray-scale levels, are generated. However, a relative ratio of the display step to the display gray-scale level becomes low as a whole. Also, a gray scale adjustment method such as the error diffusion method can be used concurrently. As a result, it is possible to provide a high-quality image display.

It should be noted here that although in the present embodiment, the gray scale of the input and output image signals is composed of values from "0" to "63", and the luminance weight values are "1", "2", "4", "8", "16", and"32", the present invention can be achieved with any other appropriate value ranges than these.

Embodiment 2

A plasma display PD2 as the second embodiment of the present invention will be described, focusing on the differences from Embodiment 1.

Figure 5:
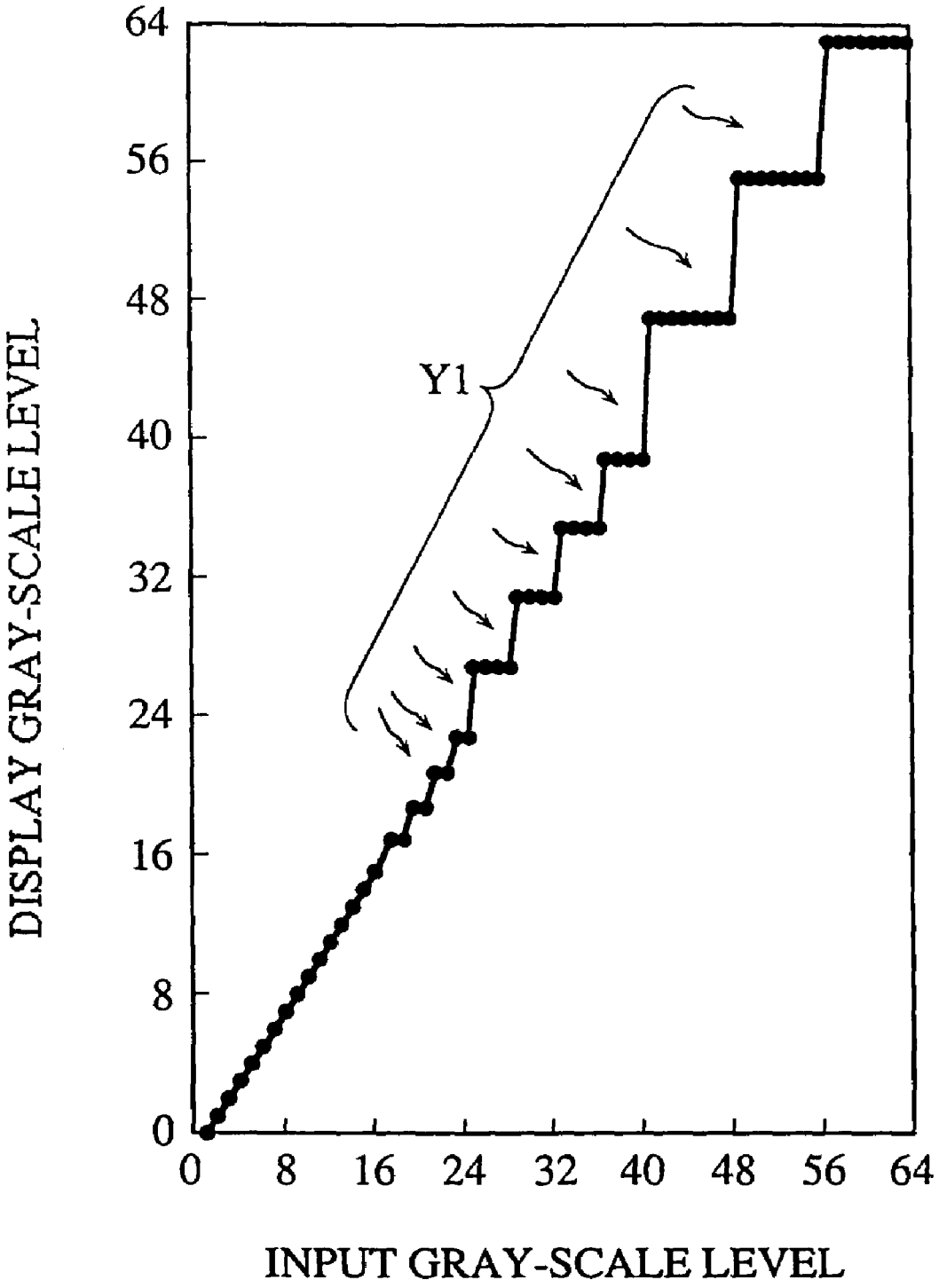
FIG. 5 is a plot, based on the data shown in FIG. 4, of display gray-scale levels on the vertical axis vs. input gray-scale levels on the horizontal axis.

FIG. 4 shows relationships between gray-scale levels contained in the input image signals and grayscale levels used for displayed images, in the case of the plasma display PD2. In other words, FIG. 4 shows relationships between inputs and outputs of the input image signal conversion unit 2 shown in FIG. 1. FIG. 5 is a plot of display gray-scale levels on the vertical axis vs. input gray-scale levels on the horizontal axis.

In the present embodiment, as the gray-scale level increases, the lower bits are fixed to "1" intentionally.

For example, when an image signal with a gray-scale level "10" (the sub-field information for this input value is "001010") is input, the output gray-scale level is also "10" (the sub-field information for this output value is also "001010"). That is to say, since the input gray-scale level "10" has a low luminance, the bit-width setting unit 21 sets such a modification bit width as allows the AND gate 22 to output the same sub-field information values as those for the input image signal. That is, the entire bit width as received is determined as the effective bit width.

On the other hand, when an image signal with a gray-scale level "50" (the sub-field information for this input value is "110010") is input, the output gray-scale level is "55" (the sub-field information for this output value is "110111"). That is to say, since the input gray-scale level "50" has a high luminance, the bit-width setting unit 21 sets such a modification bit width as allows the AND gate 22 to output sub-field information values whose lower bits are fixed to "1".

In the above case, the bit-width setting unit 21 sets, for example, 3 bits "101" as the modification bit width. The AND gate 22 then receives the modification bit width "101", performs a logical operation using these bits, and outputs "110111" representing the gray-scale level "55", as the display information. As a result of this, the lower bits are fixed to "1".

As described above, in response to high input gray-scale levels with high luminance, the change between adjacent display luminance levels (output gray-scale levels) is less, with the lower sub-fields being fixed. With this arrangement, the driving waveform of the address electrode does not change over a series of adjacent input pixel values (gray-scale levels). This reduces the power consumption of the address driver.

Compared with Embodiment 1 in which the maximum display gray-scale level is lower than the maximum input display gray-scale level, the arrangement in the present embodiment provides the effect of maintaining the peak luminance.

Embodiment 3

A plasma display PD3 as the third embodiment of the present invention will be described, focusing on the differences from Embodiments 1 and 2.

Figure 7:
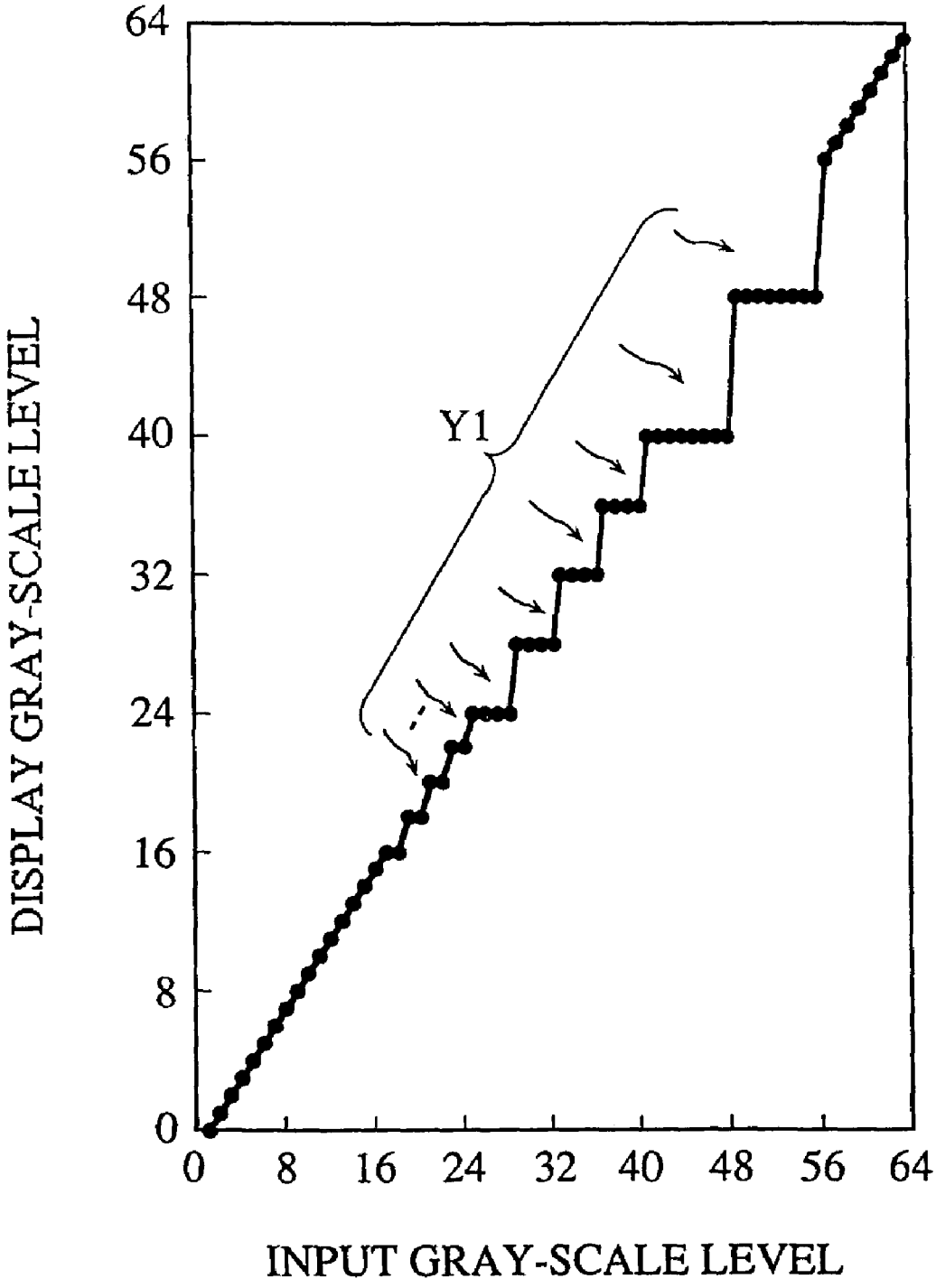
FIG. 7 is a plot, based on the data shown in FIG. 6, of display gray-scale levels on the vertical axis vs. input gray-scale levels on the horizontal axis.

FIG. 6 shows relationships between gray-scale levels contained in the input image signals and grayscale levels used for displayed images, in the case of the plasma display PD3. In other words, FIG. 6 shows relationships between inputs and outputs of the input image signal conversion unit 2 shown in FIG. 1. FIG. 7 is a plot of display gray-scale levels on the vertical axis vs. input gray-scale levels on the horizontal axis.

In the present embodiment, as the gray-scale level increases, the lower bits are intentionally fixed to "0", but for a set of input gray-scale levels closer to the maximum gray-scale level, the input gray-scale levels are output as they are as display gray-scale levels.

For example, when an image signal with a gray-scale level "10" (the sub-field information for this input value is "001010") is input, the output gray-scale level is also "10" (the sub-field information for this output value is also "001010"). On the other hand, when an image signal with a gray-scale level "50" (the sub-field information for this input value is "110010") is input, the output gray-scale level is "48" (the sub-field information for this output value is "110000"). Also, when an image signal with a gray-scale level "60" (the sub-field information for this input value is "111100") is input, the output gray-scale level is also "60" (the sub-field information for this output value is "111100"). That is to say, since the input gray-scale level "60" is close to the maximum gray-scale level, the bit-width setting unit 21 sets such a modification bit width as allows the AND gate 22 to output the same sub-field information values as those for the input image signal.

With such an arrangement, in response to middle and high input gray-scale levels with middle and high luminance, the change between adjacent display luminance levels (output gray-scale levels) is less, with the lower sub-fields being fixed. This enables the driving waveform of the address electrode not to change over a series of adjacent input pixel values (gray-scale levels). This reduces the power consumption of the address driver.

In addition to this, for a set of input gray-scale levels closer to the maximum gray-scale level (in a box encircled by a dotted line in FIG. 6), sub-fields with small luminance weights are set to "ON". This arrangement provides the effect of maintaining the peak luminance.

Embodiment 4

Figure 8:
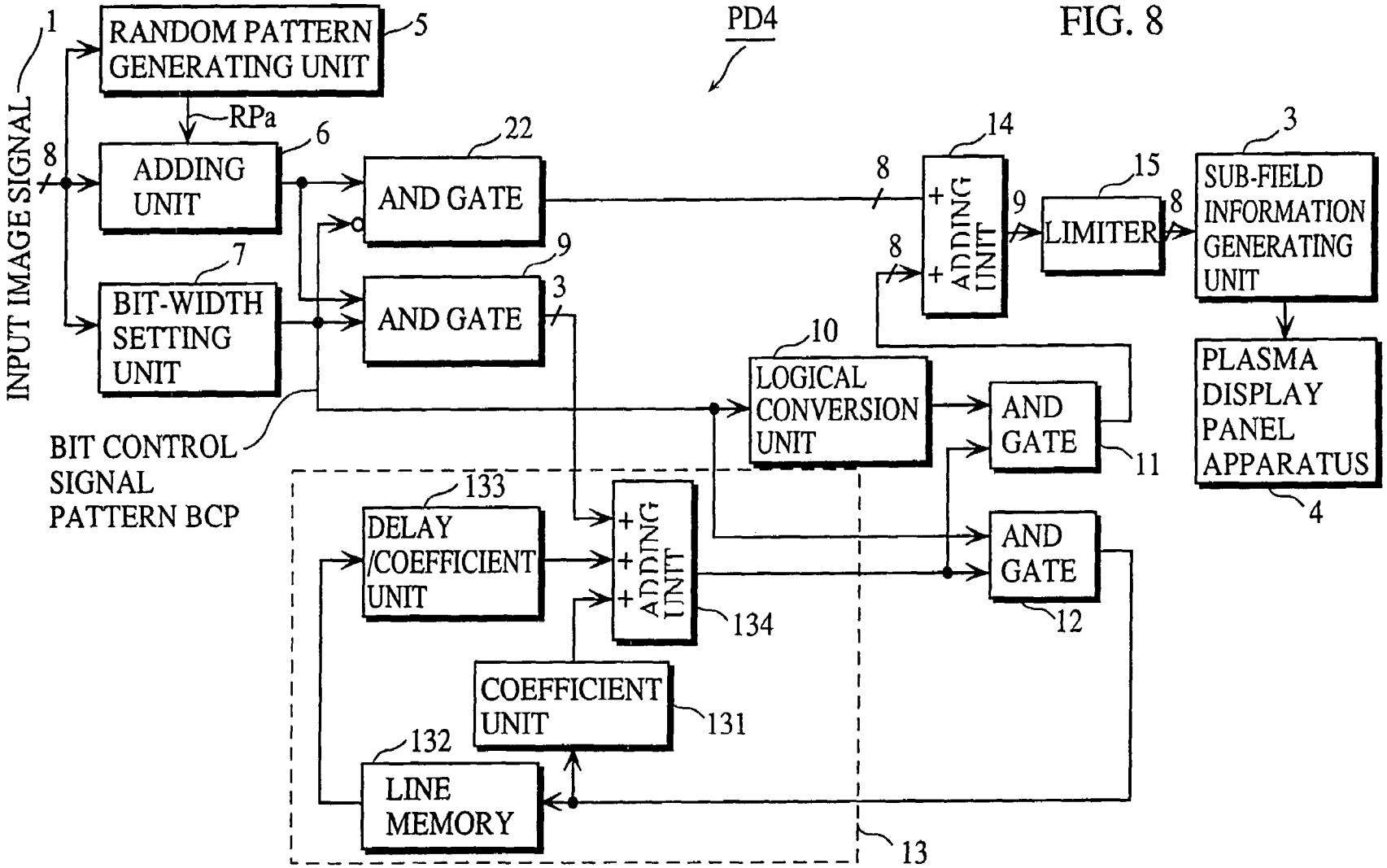
FIG. 8 is a block diagram showing the construction of a plasma display PD4 in Embodiment 4 of the present invention.

FIG. 8 shows the construction of a plasma display PD4 in Embodiment 4 of the present invention. FIG. 9 shows truth values resulting from operation examples performed by a logical conversion unit 10 shown in FIG. 8. The present embodiment will be described with reference to FIGS. 8 and 9.

As shown in FIG. 8, the plasma display PD4 includes a random pattern generating unit 5, an adding unit 6 for adding up the input image signal 1 and an output from the random pattern generating unit 5, a bit-width setting unit 7 for setting a bit width in correspondence with a gray-scale level contained in the input image signal 1, AND gates 8 and 9 for performing a logical operation using outputs from the adding unit 6 and the bit-width setting unit 7, a logical conversion unit 10 for performing a. logical conversion of an output from the bit-width setting unit 7, an AND gate 11 for carrying out the logical AND between outputs of the logical conversion unit 10 and an adding unit 134, an AND gate 12 for carrying out the logical AND between outputs of the bit-width setting unit 7 and the adding unit 134, an error diffusion processing unit 13 composed of coefficients and delays forming an error diffusion loop (a coefficient unit 131, a line memory 132, a delay/coefficient unit 133, the adding unit 134 and the like), an adding unit 14 for adding up outputs of the AND gates 8 and 11, a sub-field information generating unit 3 for converting an image signal containing a gray-scale level into a sub-field ON/OFF pattern, and a plasma display panel apparatus 4 for displaying a gray-scale image based on the sub-field patterns.

Now, the operation of the plasma display PD4 of the present embodiment will be described, together with an explanation of the function of each component. In accordance with the gray-scale level of the input image signal 1, the random pattern generating unit 5 generates a random pattern RPa. The random pattern RPa is as follows, for example. When the gray-scale level of the input image signal 1 is less than "16", a bit value "0" is added to the lowest bit of the gray-scale level; and when the gray-scale level of the input image signal 1 is no less than "16", a bit value "1" is added to the lowest bit of the gray-scale level. The adding unit 6 adds a bit value to the lowest bit of the gray-scale level according to the random pattern RPa. This arrangement prevents a certain display pattern, which may be generated in the error diffusion to be performed downstream from this operation, from becoming noticeable as a fixed pattern.

The bit-width setting unit 7 generates for each pixel, from the input image signal 1, a bit control signal pattern BCP that corresponds to a bit width M that is used in the actual display. For example, the following preconditions are set beforehand. (A) When the gray-scale level of the input image signal 1 is less than N1, M=0. (B) When the gray-scale level of the input image signal 1 is no less than N1 and less than N2, M=1. (C) When the gray-scale level of the input image signal 1 is no less than N2 and less than N3, M=2. (D) When the gray-scale level of the input image signal 1 is no less than N3, M=3. In the above preconditions, N1, N2, and N3 are integers that satisfy the condition N1<N2<N3<N. Then, the bit-width setting unit 7 generates bit control signal patterns "000", "001", "011", and "111" in correspondence with M=1, M=2, M=3, and M=4, respectively.

A logical operation between the output of the adding unit 6 and a control signal being a reversed output of the bit-width setting unit 7 is then carried out. As a result of this, for example, when the output of the adding unit 6 is "00110010" representing gray-scale level "50", one of four values ("00110000" to "00110010"), which is in reality equivalent to a result of truncating one of lower 0 to 3 bits from the output of the adding unit 6. Also, a logical operation between the output of the adding unit 6 and the output of the bit-width setting unit 7 is carried out. The result, which is in reality equivalent to the lower 3 bits of the output of the adding unit 6, is provided to the adding unit 134.

The signal provided to the adding unit 134 is equivalent to a difference between the display gray-scale level and the input gray-scale level. The output of the adding unit 134 is supplied to what is called error diffusion loop which is a system composed of the AND gate 9, coefficient unit 131, line memory 132, and delay/coefficient unit 133. Accordingly, by adding the "carry" signal, which is a result output from the error diffusion loop, to the output of the AND gate 8, which is equivalent to a value whose lower bits have been truncated, an image, for which lower bits have been truncated and visually, the original gray-scale level has been resumed as much as possible, is displayed.

In the present embodiment, however, the number of display effective bits is determined in units of pixels in accordance with each pixel value in the input image signal. As a result, a typical conventional error diffusion method itself cannot be applied to the present embodiment. In the present embodiment, the error diffusion is correctly performed in determining the effective display bits not by adding a 1-bit carry signal, but by adding a value, which is obtained as a result of a logical operation for each pixel in accordance with the number of truncated bits, to a signal composed of a plurality of bits being an output of the error diffusion calculation.

FIG. 9 shows an example of truth values resulting from such calculation by the logical conversion unit 10. As shown in FIG. 9, in response to an input of the bit control signal pattern BCP that is an output of the bit-width setting unit 7, a control signal is output to be supplied to the AND gate 11. For example, in response to an input "000", addition of "1" is performed a plurality of times until the value is carried to the $7^{th}$ bit. At this time, the lower 6 bits are "000000". This concept is applied to generation of other output signals.

It should be noted here that the above-described error diffusion loop can be achieved by a simple logical operation circuit or addition circuit. To enable the error diffusion loop to operate at a high speed, it is preferable that the error diffusion loop is made as a circuit that can easily be achieved as an LSI.

Now, how the error diffusion process is performed while the effective bit width is changed for each pixel.

As described earlier, the output of the AND gate 8 is "temporary display data", with it's lower bits having been truncated. When a signal output from the error diffusion process loop 13 is "0", the output of the AND gate 8 is used for display as it is. Ordinarily, however, "display errors" diffused from peripheral pixels have accumulated in the error diffusion loop by this time. It may therefore become necessary to correct the "temporary display data" before display, depending on the result of summation of the accumulated display errors and the output of the AND gate 9 which is a display truncation error for a focused pixel at this time. Here, suppose that a great amount of errors of the peripheral pixels have been accumulated and that the focused pixel has a middle gray-scale level, then the value carried from the peripheral pixels may higher than the error truncated from the focused pixel by "1" or more. Taking this into consideration, the correction of the "temporary display data" is not performed by simply adding "truncation error+1" to the "temporary display data", but by using a value that is a result of a calculation in which the lower bits of the accumulated error are changed to "0", as shown in the truth values of FIG. 9. With this arrangement, it is possible to keep the number of effective bits and allow the adding unit 14 to add the errors diffused from the peripheral pixels to the gray-scale level represented by the effective bits and generate the display data. It is therefore possible to appropriately control the display gray-scale levels by the error diffusion method in units of pixels, while setting the effective display bits in connection with the gray-scale level of the input image signal 1.

More particularly, in the above example, the output of the AND gate 8 is "00110000" and the number of effective bits is 6, and the output of the logical conversion unit 10 is also 6 bits. Here, suppose, for example, that the output of the AND gate 11 is "00110100", then the output of the AND gate 14 is "01000100". This indicates the above-described effect that the lower bits are fixed to "0" as described in Embodiment 1 while the error diffusion process is executed.

As described above, one of the characteristics of the present embodiment is the calculation of the AND gate 11 for fixing the lower bits to "0" (since the lower bits of the output signal of the logical conversion unit 10 are "0"). In addition to this, another characteristic of the present embodiment is that frequent signal changes for the lower bits are restricted in displaying middle or higher gray-scale levels since even the adding unit 14 outputs display gay-scale levels in which adjacent middle or higher gray-scale levels have common lower bits. This reduces the power consumption in the address driver of the plasma display apparatus. Also, even if the truncated bit width changes for every pixel, the display error can be correctly diffused to the peripheral pixels in response to the change of bit width. This provides a high-quality image display for a wide range of gray-scale levels ranging from low luminance to high luminance, while reducing the power consumption in the address driver.

Note that the output of the adding unit 14 may include an overflow, which is handled by the limiter 15.

As described above, the present embodiment provides a high-quality image display for a wide range of gray-scale levels ranging from low luminance to high luminance, while reducing the power consumption in the address driver, and correcting the gray-scale characteristics by the error diffusion method, which is enabled by setting the effective display bits and processing bits for the display error calculation in response to the input gray-scale levels in units of pixels.

Although the number of effective bits is dynamically changed in units of pixels, the elements of the present embodiment constituting the error diffusion loop may be logical operation circuits or addition circuits with simple construction. This enables the present embodiment to be easily achieved in an LSI and operate at a high speed.

Embodiment 5

Figure 10:
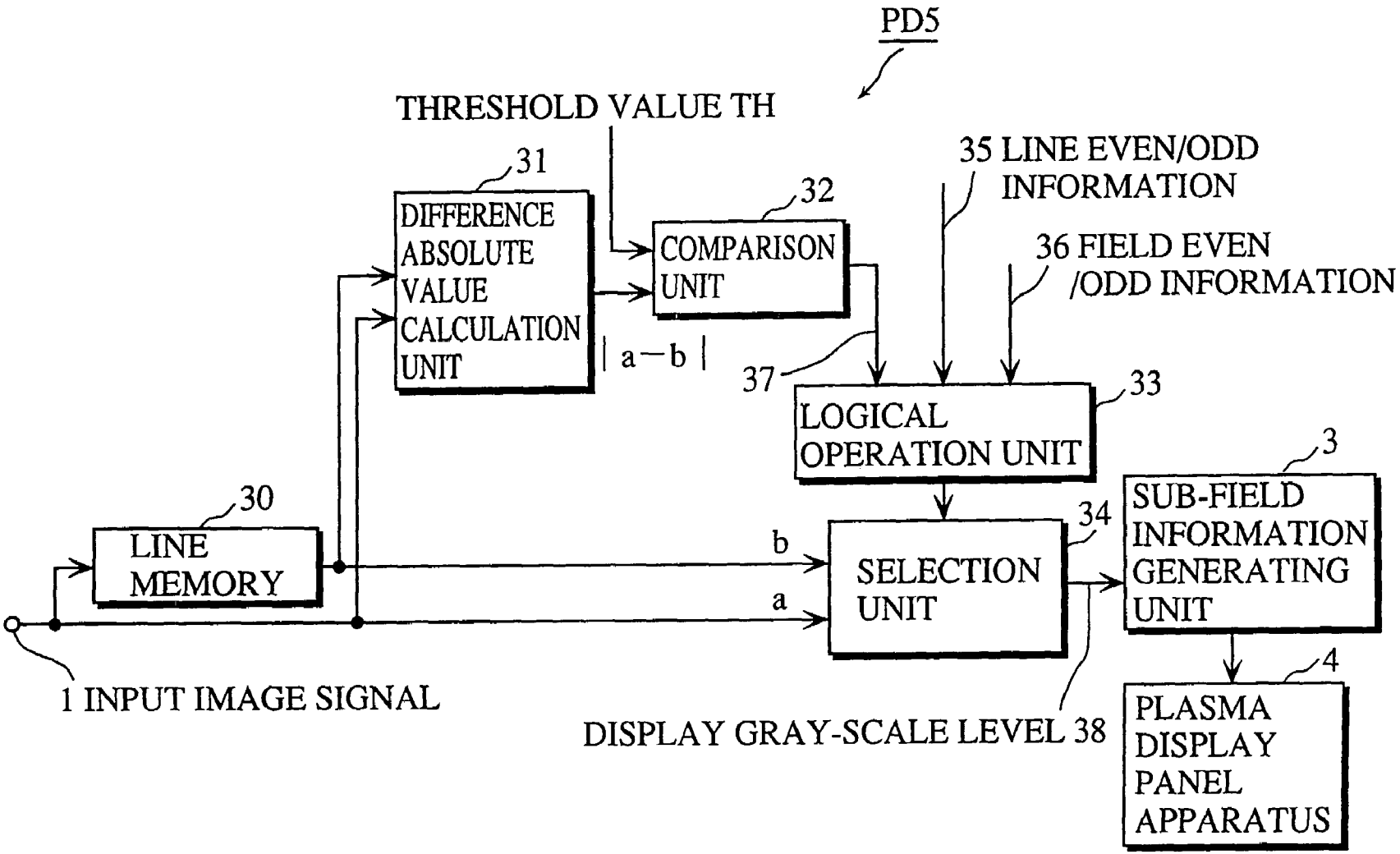
FIG. 10 is a block diagram showing the construction of a plasma display PD5 in Embodiment 5 of the present invention that displays gray-scale images using sub-fields.

FIG. 10 is a block diagram showing the construction of a signal processing portion of a plasma display PD5 in the fifth embodiment of the present invention that displays gray-scale images using sub-fields.

As shown in FIG. 10, the plasma display PD5 includes a line memory 30, a difference absolute value calculation unit 31 for calculating a difference between two inputs and an absolute value of the difference, a comparison unit 32, a logical operation unit 33, a selection unit 34, a sub-field information generating unit 3 for generating the sub-field information, and a plasma display panel apparatus 4 being a panel on which various driving circuits are wired.

In FIG. 10, the element number 1 indicates an input digital image signal, the element number 35 indicates line even/odd information that shows the line number is an even number or an odd number, and the element number 36 indicates field even/odd information that shows the field number is an even number or an odd number.

The following is a description of the operation of the image display apparatus having the above construction. The function of each element will also be described.

First, the difference absolute value calculation unit 31 calculates a difference, for each pair of adjacent pixels, between gray-scale levels of the pixels on vertically adjacent lines of the input image signal 1 in the line memory 30, and the absolute value of the difference. The comparison unit 32 compares the absolute value with a predetermined threshold value (TH) for each pixel. The threshold value (TH) is determined based on an experience relating to the effect of reducing power used for writing, which will be described later. This applies to any other threshold values that may appear from now on.

The comparison result (signal 37) is input to the logical operation unit 33. The logical operation unit 33 also receives the line even/odd information and the field even/odd information in relation to the comparison result. The selection unit 34 selects either the signal "a" for the current line or the signal "b" for the previous line. The selection method is determined in accordance with the relationships shown in FIGS. 11 and 12.

Figure 11:
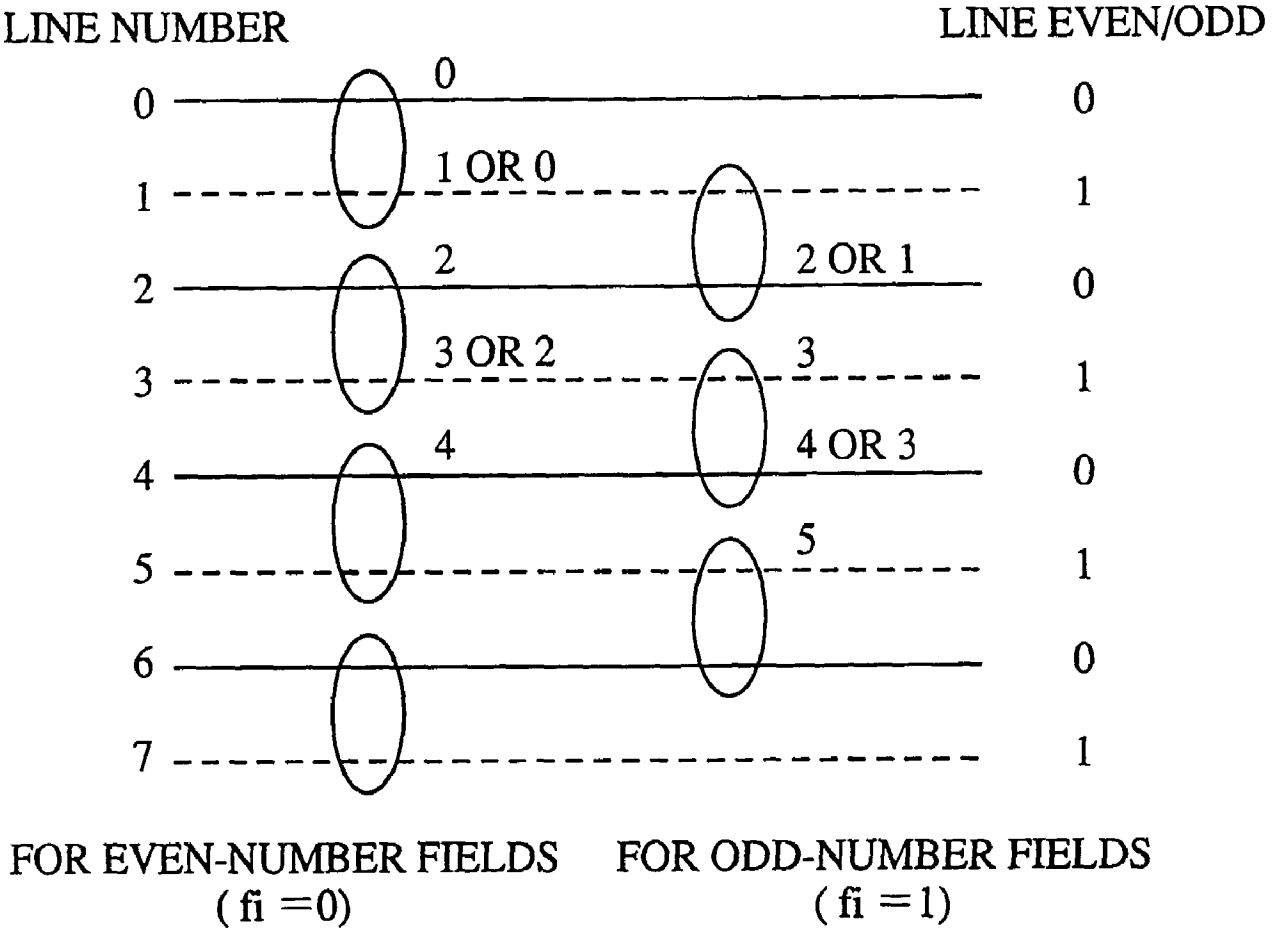
FIG. 11 shows how the selection unit 34 performs a selection.

For more specific explanation, an example in the case of an even-number field will be taken with reference to FIGS. 11 and 12. When the difference between gray-scale levels of the pixels on the line 0 and the line 1 is great, the signals on the line 0 and the line 1 are output as they are for the line 0 and the line 1, respectively; and when the difference is small, the signal on the line 0 is output for both the line 0 and the line 1. This rule is also applied to the case of an odd-number field. The selected signal is output from the selection unit 34 as a display gray-scale level (signal 38).

It is desirable that the combination of each pair of lines for which the input values are compared is different between the even-number and odd-number fields, as shown in FIG. 11. That is to say, in the case of an even-number field, the comparison is performed between lines 0 and 1, 2 and 3, 4 and 5, . . . ; and in the case of an odd-number field, the comparison is performed between lines 1 and 2, 3 and 4, 5 and 6, . . . This arrangement substantially eliminates the visual effect that is generated by changing the gray-scale levels of the pixels on each line.

As described above, when the difference between two signals is lower than the threshold value TH as a result of a comparison between a pair of adjacent lines, each pair being indicated by ellipses in FIG. 11, the two signals are adjusted to be equal to each other. This allows the two sets of sub-fields on the two lines to have the same values. Accordingly, changes in the driving waveform to the address electrode are restricted, and the power consumption in the address driver is reduced. It should be noted here that the above arrangement of making the two signals on the adjacent lines have the same value does not bring a noticeable change in the display image to the naked eye, without resulting in an image quality degradation. Also, the two signals on the adjacent lines are not changed at the edge portions of the image. That means image quality degradations such as blurry edges or edge position changes do not occur.

In the present embodiment, either even-number or odd-number lines have original signals completely. As a result, even if the threshold value TH is set to a higher value to increase the effect of reducing the power consumption, the original image information is always kept in either even-number or odd-number lines. This prevents the image quality from being greatly degraded.

Embodiment 6

Figure 13:
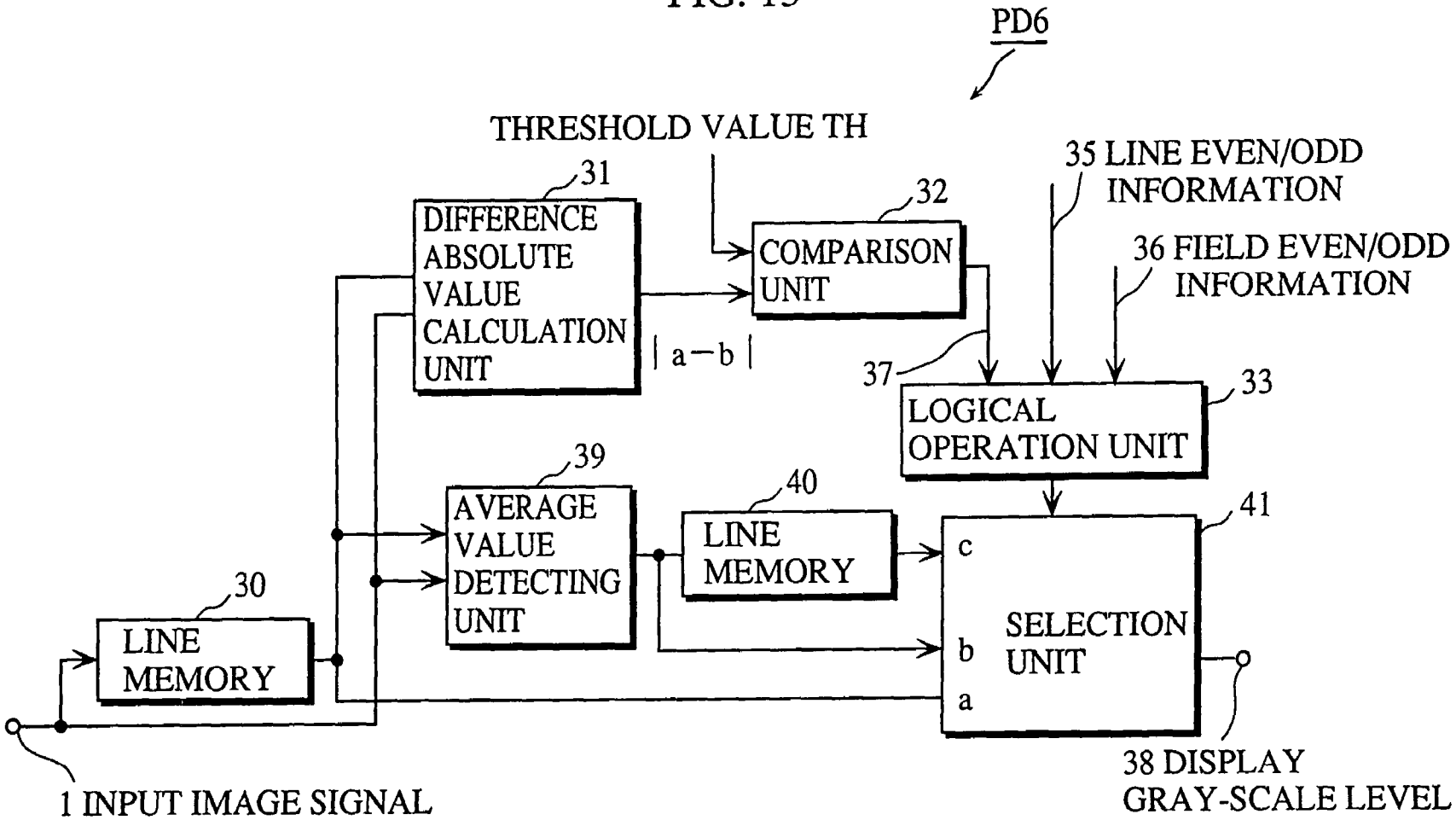
FIG. 13 is a block diagram showing the construction of a plasma display PD6 in Embodiment 6 of the present invention that displays gray-scale images using sub-fields.

FIG. 13 is a block diagram showing the construction of a signal processing portion of a plasma display PD6 in the sixth embodiment of the present invention that displays gray-scale images using sub-fields.

The construction shown in FIG. 13 differs from that shown in FIG. 10 in that it has an average value detecting unit 39 and a line memory 40, and that it has a selection unit 41 instead of the selection unit 34.

Now, Embodiment 6 will be described mainly on the differences from Embodiment 5.

The input image signal 1 is input to the average value detecting unit 39 in two ways, directly and via the line memory 30. The output of the average value detecting unit 39 is input to the selection unit 41 via the line memory 40. The selection unit 41 receives outputs of three units: the line memory 30, the average value detecting unit 39, and the line memory 40, and performs selection in accordance with the relationships shown in FIGS. 14 and 15, and outputs the selection results.

Figure 14:
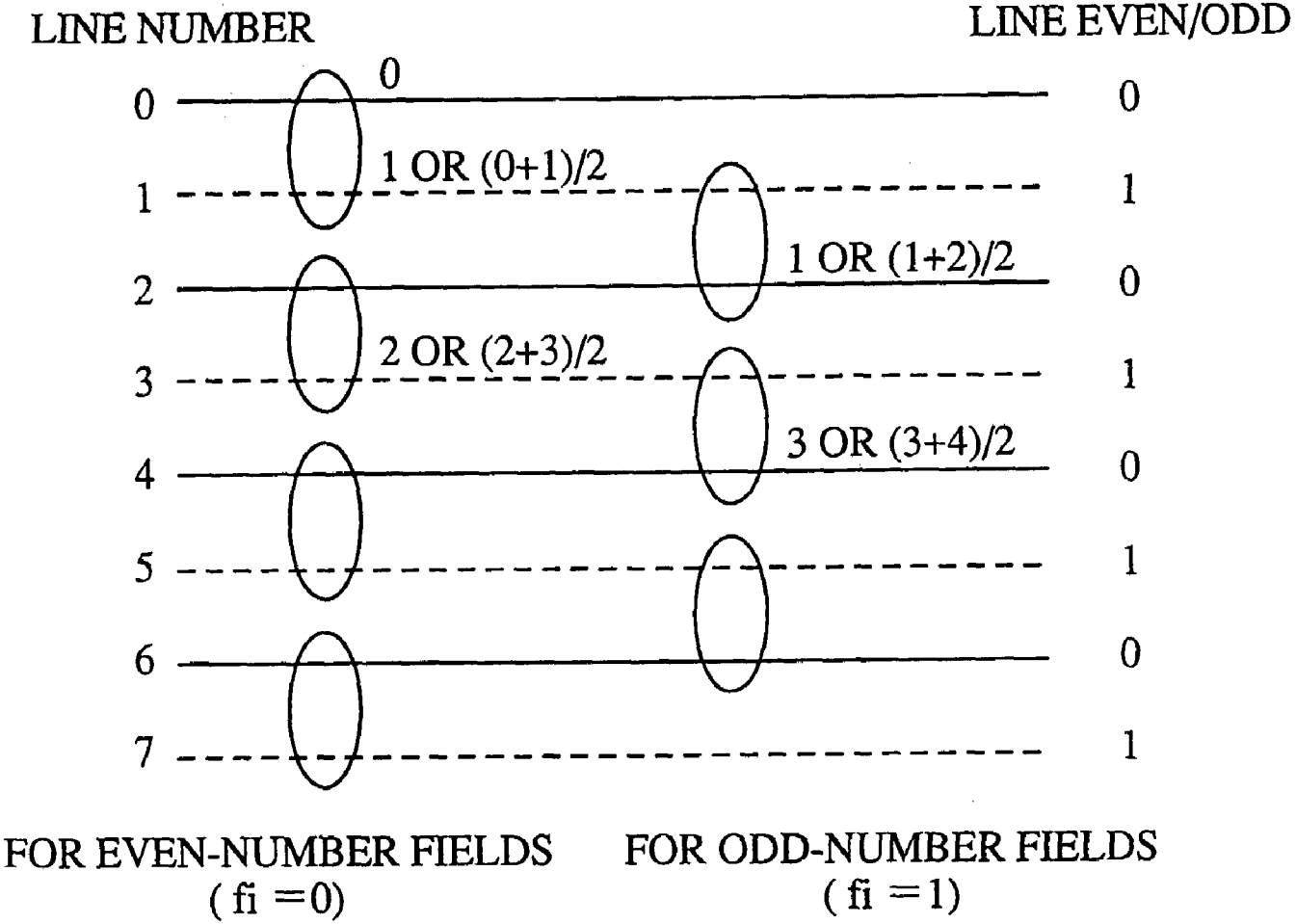
FIG. 14 shows how the selection unit 41 performs a selection.

For more specific explanation, an example in the case of an even-number field will be taken with reference to FIGS. 14 and 15. When the difference between gray-scale levels of the pixels on the line 0 and the line 1 is great, the signals on the line 0 and the line 1 are output as they are for the line 0 and the line 1, respectively; and when the difference is small, a signal ("c" in the "SELECTED INPUT" column) having an average value of the two signals is output for both the line 0 and the line 1. This rule is also applied to the case of an odd-number field.

As described above, when the difference between two signals on the adjacent lines is small, each of the two signals is replaced with their average value; and when the difference is great, the signals are output as they are. This allows changes in the driving waveform to the address electrode to be restricted and the power consumption in the address driver to be reduced, while restricting the image quality degradation.

It should be noted here that the above arrangement of replacing the signal value with an average value of two signals does not bring a noticeable image quality degradation even if the threshold value TH1 is set to a higher value. This is because the calculation of the average value always maintains the half of the original line information.

It should be noted here that the comparison between gray-scale levels, which is performed for each pair of adjacent pixels on vertically adjacent lines in Embodiments 5 and 6, may be performed for each set of three or more adjacent pixels. In this case, a standard pixel is set in each area containing a certain set of adjacent pixels, and gray-scale levels of pixels excluding at least the standard pixel in the area are changed so as to increase the number of pieces of display information that have, in common, sub-fields having a same pattern between adjacent pixels. The comparison between (a) a difference between two signal values representing gray-scale levels of two pixels and (b) a threshold value, which is performed in the case of two-value comparison, is substantially the same as the case where one of the two pixels is selected as the standard pixel.

In another variation, a standard pixel is set in each area containing a certain set of adjacent pixels, and when a difference between a gray-scale level of a pixel in the area and that of the standard pixel is lower than a certain value, the gray-scale level of the pixel in the area and the gray-scale level of the standard pixel are adjusted to be equal to each other.

Embodiment 7

In general, in displaying of a checkered pattern, the luminance of the pixels changes both vertically and horizontally. This greatly changes the display information to be written into the address electrode. That is to say, this greatly changes the driving waveform of the address electrode, and increases the power consumed when the address driver writes data. The image display apparatus of the present embodiment is based on an intention to control the original gray-scale levels in the checkered pattern area to reduce the change of the driving waveform of the address electrode, and restrict the power consumed when the address driver writes data. The following is a detailed description of the construction and operation of the image display apparatus.

Figure 16:
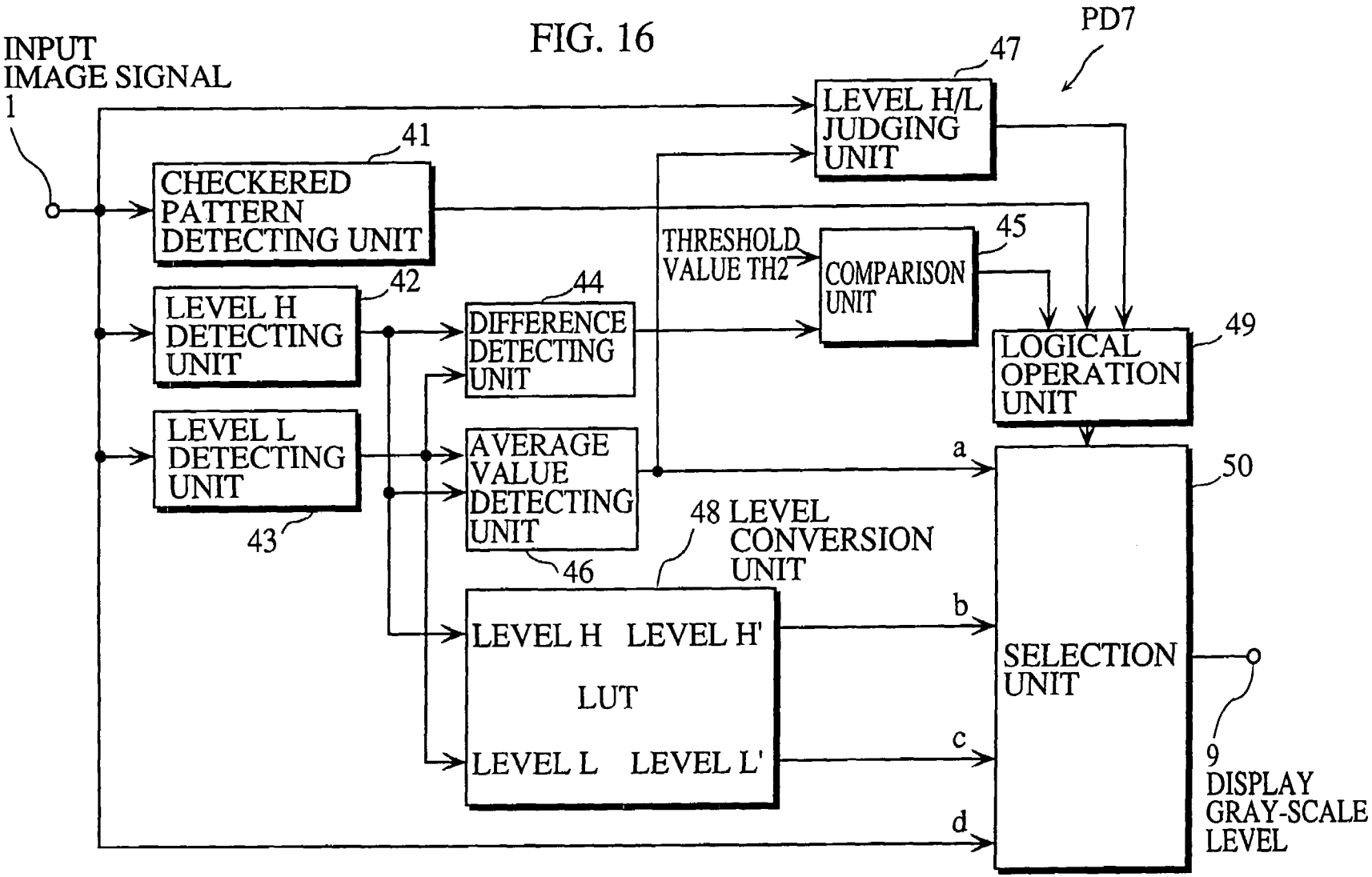
FIG. 16 is a block diagram showing the construction of a plasma display PD7 in Embodiment 7 of the present invention that displays gray-scale images using sub-fields.

FIG. 16 is a block diagram showing the construction of a signal processing portion of a plasma display PD7 in the seventh embodiment of the present invention that displays gray-scale images using sub-fields.

As shown in FIG. 16, the plasma display PD7 includes, as a signal processing unit for generating the display information that is supplied to the plasma display panel apparatus, a checkered pattern detecting unit 41, a level H detecting unit 42, a level L detecting unit 43, a difference detecting unit 44, a comparison unit 45, an average value detecting unit 46, a level H/L judging unit 47, a level conversion unit 48, a logical operation unit 49, and a selection unit 50.

The checkered pattern detecting unit 41 detects, for example, a checkered pattern which is a portion of the input image signal 1 in which values regularly change in units of pixels. The level H detecting unit 42 detects a signal having a high luminance as "level H", among signals that constitute the checkered pattern. The level L detecting unit 43 detects a signal having a low luminance as "level L", among signals that constitute the checkered pattern. The difference detecting unit 44 detects a difference between the level H and the level L. The comparison unit 45 compares the difference with a threshold value TH2 for the judgment on which is higher. Note that each of the level H and the level L may be a plurality of different values depending on the pixel values constituting the checkered pattern. In the present example, however, it is supposed that each of the level H and the level L is a single value for the sake of convenience. This does not change the operation or effects of the present embodiment.

The average value detecting unit 46 calculates an average value between the level H and the level L. The level conversion unit 48 generates another pair of "level H'" and "level L'" from the pair of the level H and the level L.

The logical operation unit 49 determines selects one out of outputs of the checkered pattern detecting unit 41, comparison unit 45, and level H/L judging unit 47, and supplies the selected output to the selection unit 50.

FIG. 17 shows an operation of the level conversion unit 48. As shown in FIG. 17, the level conversion unit 48 determines a value to be input to the selection unit 50 based on the difference between luminance levels constituting the checkered pattern, whether it is a checkered pattern, and whether the gray-scale level of the pixel is high or low.

Figure 18:
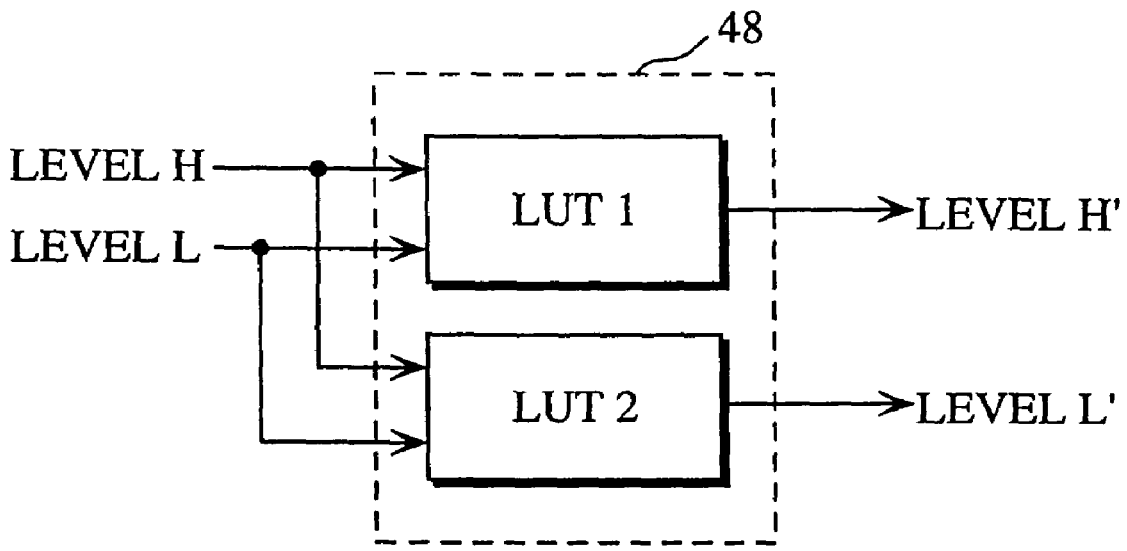
FIG. 18 shows the function of the level conversion unit 48 as look-up tables.

Here, the operation of the level conversion unit 48 will be described in detail. As shown in FIG. 18, the level conversion unit 48 functions as look-up tables (LUT 1 and LUT 2) that are used to calculate new signals "level H'" and "level L'" from the level Hand the level L, respectively. The outputs of the tables "level H'" and "level L'" are determined so that they have more common bit values with the input signals "level H" and "level L", that the average value between "level H" and "level L" is close to the average value between "level H'" and "level L'" as possible, and that the difference between "level H" and "level L" is close to the difference between "level H'" and "level L'" as possible.

Figure 19:
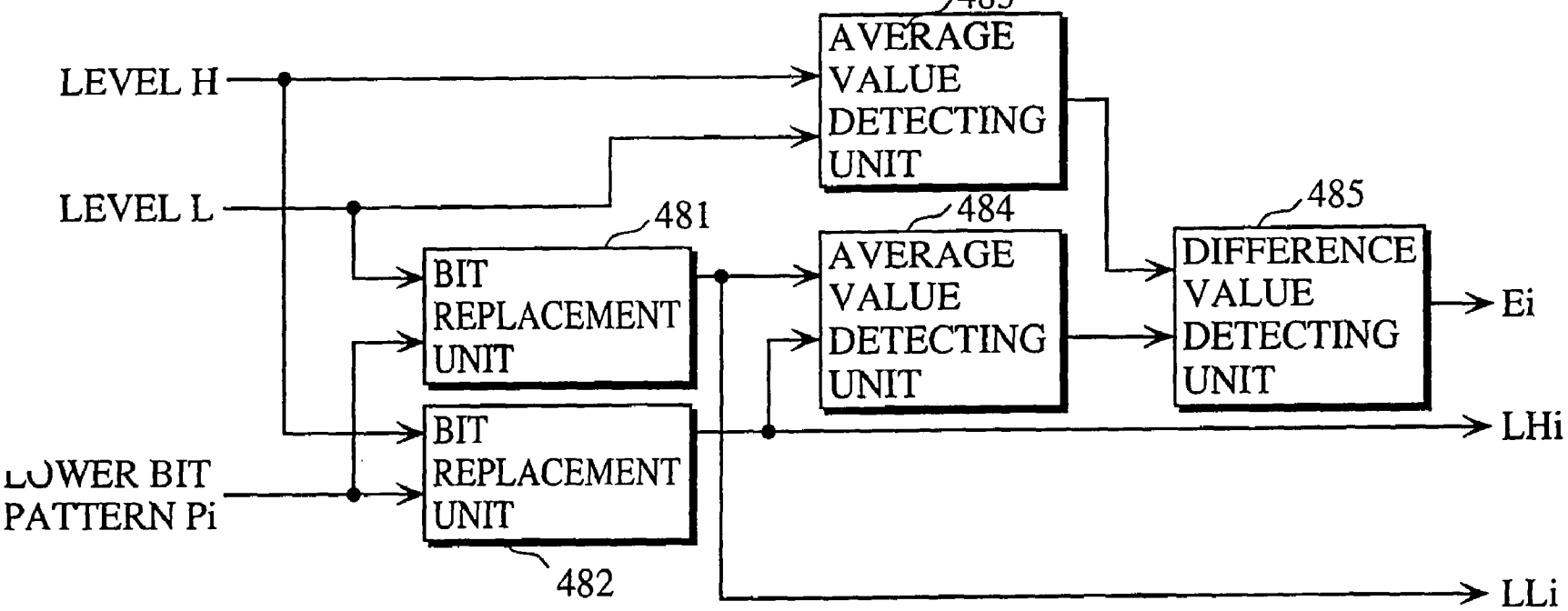
FIG. 19 is a functional block diagram that shows the construction for determining the contents of the tables shown in FIG. 18.
Figure 25:
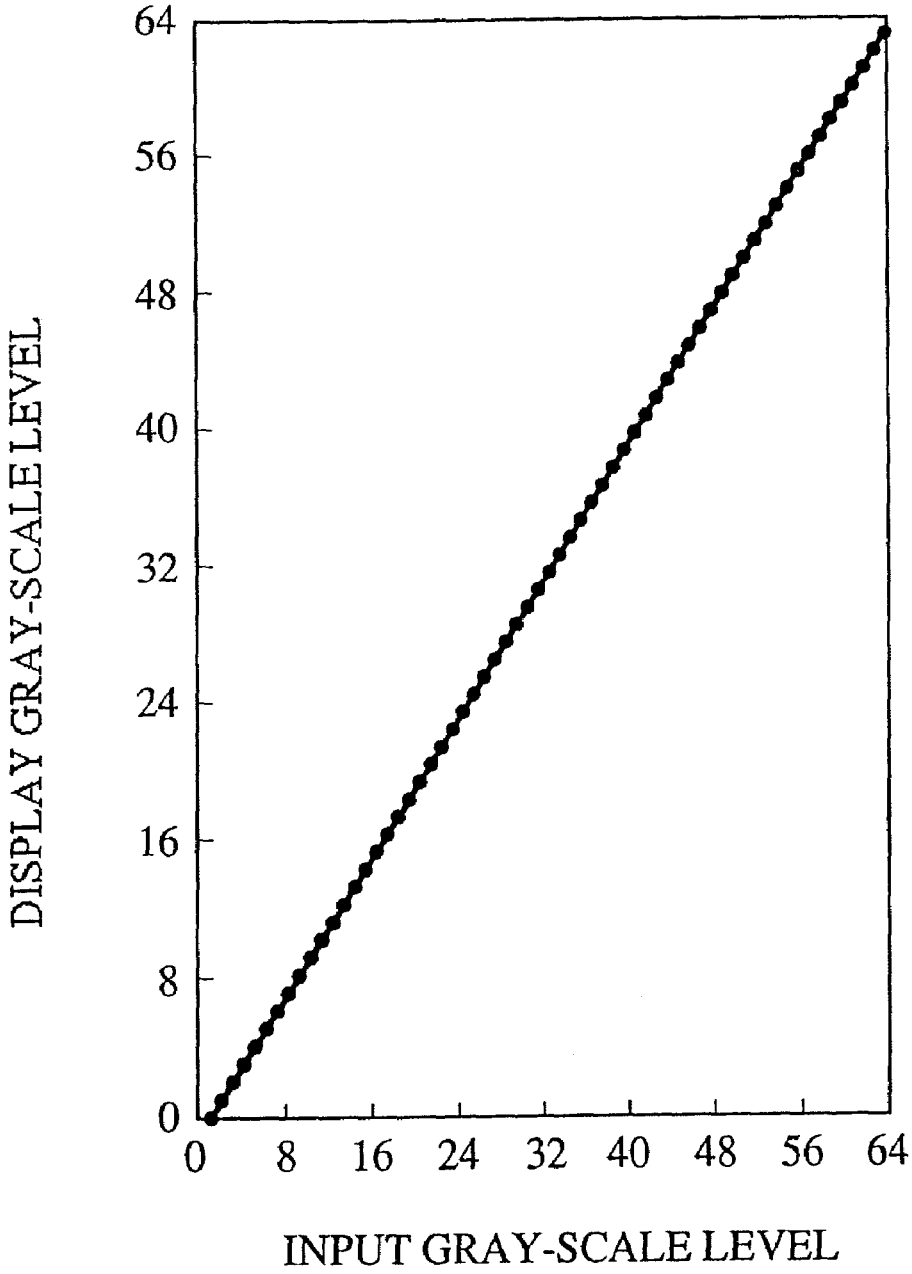
FIG. 25 PRIOR ART
FIG. 25 is a plot, based on the data shown in FIG. 24, of display gray-scale levels on the vertical axis vs. input gray-scale levels on the horizontal axis.
Figure 26:
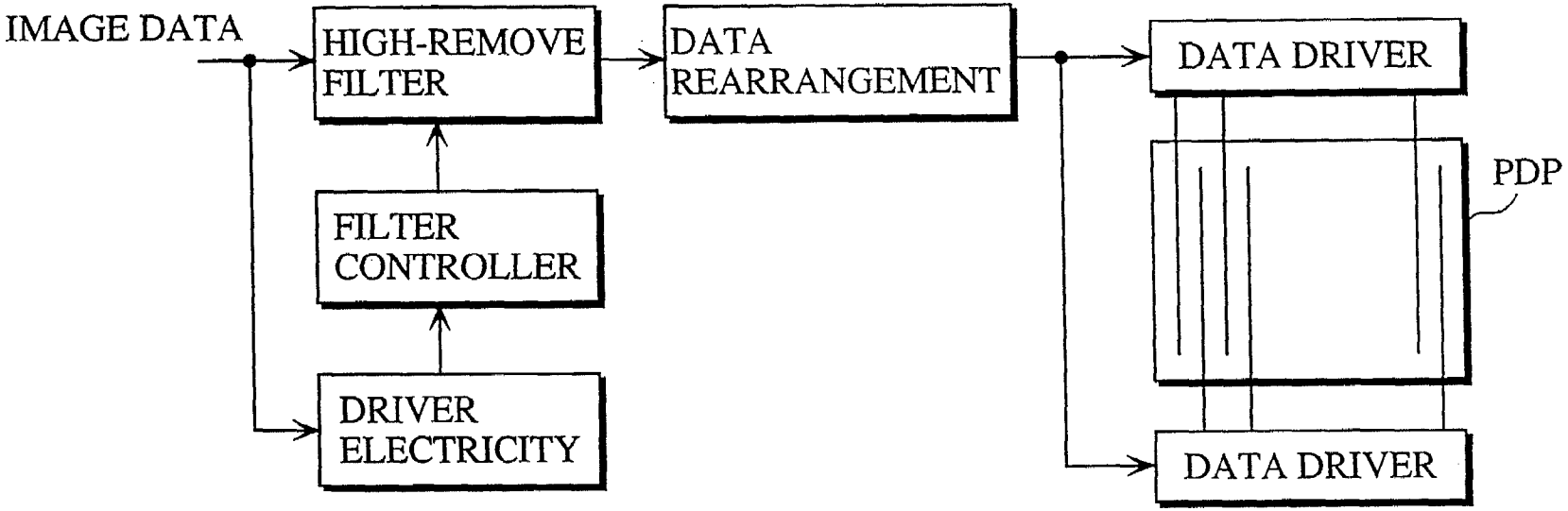
FIG. 26 PRIOR ART
FIG. 26 shows a conventional construction for achieving the effect of reducing the amount of power consumed in the address driver.

FIG. 19 shows an example of the construction that determines the contents of the tables. The operation with the construction shown in FIG. 19 will be described. When two luminance levels "level H" and "level L" (in this example, the levels are represented by the sub-field information) are input, bit replacement units 481 and 482 replaces the lower bits of the "level H" and "level L" with a common value "Pi", and output "LHi" and "LLi", respectively. An average value detecting unit 483 calculates an average value between the "level H" and "level L". An average value detecting unit 484 calculates an average value between the "LHi" and "LLi". A difference value detecting unit 485 calculates a difference value "Ei" between the outputs of the average value detecting units 483 and 484. The value "Pi" for replacing the lower bits of the input signals is divided into 8 patterns: "000", "100", . . . , "111". A combination of values "LHi" and "LLi" when a corresponding value "Ei" becomes the lowest are determined as outputs of the look-up tables shown in FIG. 8. Values "level H" and "level L" that are generated from "level H" and "level L" using the above-described look-up tables have the same pattern in terms of the lower three bits. Therefore, a checkered pattern composed of the "level H" and "level L", compared with the original checkered pattern composed of "level H" and "level L", restricts the change in the driving waveform of the address electrode and reduces the power consumed when the address driver writes data. In addition, since the average value between the "level H" and "level L" is close to the average value between the "level H" and "level L", the average luminance and color tone of the checkered pattern are substantially maintained.

Now, the operation in the present embodiment will be described with reference to FIG. 17. When it is judged that an input image is not a checkered pattern as a result of referring to the contents of FIG. 17, the input image signal is output as it is ("d" in the "SELECTED INPUT" column). This is because in this case, the amount of power consumed when the address driver writes data is not large. When an input image is a checkered pattern and the difference between the high and low luminance levels of the checkered pattern is small, the high and low luminance levels of the checkered pattern are each replaced with their average value ("a" in the "SELECTED INPUT" column). When an input image is a checkered pattern and the difference between the high and low luminance levels is great, the high and low luminance levels of the checkered pattern are replaced with signals that have the same lower bits ("b" and "c" in the "SELECTED INPUT" column, respectively). In reality, the selection between "b" and "c" is carried out by the level H/L judging unit 47. The level H/L judging unit 47, for example, easily executes this selection by comparing the average value of the checkered pattern area and each pixel value.

FIG. 20 shows relationships between sub-field control patterns and input gray-scale levels when gray-scale images are displayed with 12 sub-fields to which luminance weights "1", "2", "4", "8", "16", "24", "32", "32", "32", "32", "32", and "32" are assigned.

FIGS. 21 to 23 show operation examples corresponding to FIG. 17. Each of FIGS. 21 to 23 shows a process of converting "level H" and "level L" constituting an input checkered pattern to "level H'" and "level L'" to be output.

Now, an operation example will be presented with reference to FIGS. 20 and 21.

When an input checkered pattern is composed of gray-scale levels "63" and "0" with sub-field values shown in FIG. 20, the level conversion unit 48 converts the values as follows. The sub-field information for the gray-scale level "63" is represented as "1110011" (in the order from the lowest bit) with corresponding luminance values "1+2+4+0+0+24+32=63". That is to say, it contains 5 bits that are different from the corresponding bits of the gray-scale level "0" represented as "0000000". If these signals were output as they are, the address driver would consume a great amount of power to write the data. To avoid this, the lower three bits of these signals are each replaced with a value that is common to the two signals. More particularly, among 8 value options "000" to "111" for the lower three bits, "001" that is closest to the average value "31.5" between the gray-scale levels "63" and "0" is selected. The gray-scale levels "63" and "0" are then replaced with the gray-scale levels "60" and "4" that correspond to the selected pattern, "001". As shown in FIG. 20, the gray-scale level "60" is represented as "0010011" (in the order from the lowest bid) and the gray-scale level "4" is represented as "0010000". These bit patterns have only two different bits (sub-fields) at corresponding bit positions. With this arrangement, the address driver consumes less amount of power to write the data.

It is expected that the same effect of reducing the power consumption is obtained by simply truncating the lower bits. In this case, however, the two gray-scale levels constituting the checkered pattern will be "60" and "0", and the average value between them will be "30". This average value is, compared with the average value "32" in the case of the above example of the present embodiment, greatly different from the original average value "31.5". That means the average luminance value is not maintained.

Another operation example will be presented with reference to FIGS. 20 and 22.

When an input checkered pattern is composed of gray-scale levels "48" and "15" with sub-field values shown in FIG. 20, the level conversion unit 48 converts the values as follows. The sub-field information for the gray-scale level "48" is represented as "000111" (in the order from the lowest bit) with corresponding luminance values "0+0+0+8+16+24=48". That is to say, it contains 5 bits that are different from the corresponding bits of the gray-scale level "15" represented as "111100". Among 8 lower-3-bit value options "000" to "111" corresponding to 8 pairs of one of gray-scale levels "48" to "55" and one of gray-scale levels "8" to "15", as shown in FIG. 22, "001" with average value "32" that is closest to the average value "3 1.5" between the gray-scale levels "48" and "15" is selected. The gray-scale levels "48" and "15" are then replaced with the gray-scale levels "52" and "12" that correspond to the selected pattern "001". As shown in FIG. 20, the gray-scale level "52" is represented by "001111" (in the order from the lowest bit) and the gray-scale level"12" is represented as "001100". These bit patterns have only two different bits (sub-fields) at corresponding bit positions. With this arrangement, the address driver consumes less amount of power to write the data.

A further another operation example will be presented with reference to FIGS. 20 and 23.

When an input checkered pattern is composed of gray-scale levels "32" and "2" with sub-field values shown in FIG. 20, the level conversion unit 48 converts the values as follows. The sub-field information for the gray-scale level "32" is represented as "000101" (in the order from the lowest bit) with corresponding luminance values "0+0+0+8+0+24=3 2". That is to say, it contains 3 bits that are different from the corresponding bits of gray-scale level "2" represented as "010000". Among 8 lower-3-bit value options "000" to "111" corresponding to 8 pairs of one of gray-scale levels "32" to "39" and one of gray-scale levels "0" to "7", as shown in FIG. 23, "100" with average value "17" that is the same as the average value between the gray-scale levels "33" and "1" is selected. The gray-scale levels "32" and "2" are then replaced with the gray-scale levels "33" and "1" that correspond to the selected pattern "100". As shown in FIG. 20, the gray-scale level "33" is represented as "100101" (in the order from the lowest bit) and the gray-scale level "1" is represented as "100000". These bit patterns have only two different bits (sub-fields) at corresponding bit positions. With this arrangement, the address driver consumes less amount of power to write the data.

As described above, in the present embodiment, a checkered pattern is detected from input images, and at least a certain number of lower bits are replaced with a common bit pattern in units of pixels constituting the checkered pattern. This arrangement restricts the change in the driving waveform of the address electrode and reduces the power consumed when the address driver writes data. The input gray-scale levels are replaced with gray-scale levels that are determined so that the average value between the high and low luminance levels does not change so much. This arrangement restricts the change in the display luminance and the color tone. When a checkered pattern with a small difference between gray-scale levels constituting the checkered pattern is detected, the gray-scale levels are each replaced with an average value of the gray-scale levels. This further improves the power consumption reduction effect. When a checkered pattern with a great difference between gray-scale levels constituting the checkered pattern is detected, the higher bits of the gray-scale levels are maintained. With this arrangement, it is possible to maintain a certain level of the difference between the gray-scale levels constituting the checkered pattern, and keep the basic characteristic of the checkered pattern that the checkered pattern is composed of two major gray-scale levels: one with a high luminance, and the other with a low luminance. This arrangement, therefore, restricts the change in the driving waveform of the address electrode and reduces the power consumed when the address driver writes data, without greatly changing the image quality.

The present embodiment takes the case of a checkered pattern as an example. The present invention, however, can be applied to any "complicate image pattern area" such as a tile pattern that makes the address driver consume much power when writing data. In this case, the same effect as the present embodiment can be obtained.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image display apparatus for displaying gray-scale images by representing each gray-scale level of the images by an ON/OFF pattern of a set of sub-fields constituting a field in a time domain, characterized in that an area, composed of a plurality of adjacent pixels, is set in response to an input image signal, wherein gray-scale levels of one or more of the adjacent pixels is rewritten so that the adjacent pixels have a same gray-scale level, and the gray-scale images are enabled to be displayed in accordance with gray-scale levels after the adjustment; and then the gray-scale images are displayed in accordance with the rewritten display information.

2. The image display apparatus of claim 1, wherein when the display information is rewritten, from among a plurality of patterns of display information in which the plurality of sub-fields corresponding to the plurality of adjacent pixels have a same value, a pattern of display information, which corresponds to a smallest change in an average gray-scale level of adjacent pixels, between before and after the rewriting of the display information, is selected.

3. The image display apparatus of claim 2, wherein the sub-fields commonly contained in the plurality of pieces of display information are lower sub-fields among all sub-fields.

4. The image display apparatus defined in claim 3, wherein the area is composed of two adjacent lines.

5. The image display apparatus defined in claim 3, wherein the area changes regularly or irregularly in units of pixels.

6. The image display apparatus defined in claim 2, wherein the area is composed of two adjacent lines.

7. The image display apparatus defined in claim 2, wherein the area changes regularly or irregularly in units of pixels.

8. The image display apparatus of claim 1, wherein a standard pixel is set in the area, and gray-scale levels of pixels excluding at least the standard pixel in the area are changed so that the plurality of pieces of display information have, in common, sub-fields having a same pattern between adjacent pixels.

9. The image display apparatus defined in claim 8, wherein the area is composed of two adjacent lines.

10. The image display apparatus defined in claim 8, wherein the area changes regularly or irregularly in units of pixels.

11. The image display apparatus defined in claim 1, wherein the area is composed of two adjacent lines.

12. The image display apparatus defined in claim 1, wherein the area changes regularly or irregularly in units of pixels.

13. An image display apparatus for displaying gray-scale images by representing each gray-scale level of the images by an ON/OFF pattern of a set of sub-fields constituting a field in a time domain, characterized in that an area, composed of a plurality of adjacent pixels, is set in response to an input image signal, then a plurality of pieces of display information having, in common, sub-fields with a same pattern between adjacent pixels are generated, and the gray-scale images are displayed in accordance with the plurality of pieces of display information, wherein a standard pixel is set in the area, and when a difference between a gray-scale level of a pixel in the area and that of the standard pixel is lower than a value that is determined in accordance with a gray-scale level of the standard pixel indicated in the input image signal, the gray-scale level of the pixel in the area and the gray-scale level of the standard pixel are adjusted to be equal to each other.

14. The image display apparatus defined in claim 13, wherein the area is composed of two adjacent lines.

15. The image display apparatus defined in claim 13, wherein the area changes regularly or irregularly in units of pixels.

16. An image display apparatus for displaying gray-scale images by representing each gray-scale level of the images by an ON/OFF pattern of a set of sub-fields constituting a field in a time domain, comprising:

means for setting an area, composed of a plurality of adjacent pixels, in response to an input image signal wherein gray-scale levels of one or more of the adjacent pixels is rewritten so that the adjacent pixels have a same gray-scale level, and the gray-scale images are enabled to be displayed in accordance with gray-scale levels after the adjustment; and means for displaying the gray-scale images in accordance with the rewritten display information.

17. A method for displaying gray-scale images by representing each gray-scale level of the images by an ON/OFF pattern of a set of sub-fields constituting a field in a time domain, comprising:

setting an area, composed of a plurality of adjacent pixels, in response to an input image signal;

gray-scale levels of one or more of the adjacent pixels is rewritten so that the adjacent pixels have a same gray-scale level, and then the gray-scale images are displayed in accordance with gray-scale levels after the adjustment; and displaying the gray-scale images in accordance with the rewritten display information.

18. The method of claim 17 further comprising when the display information is rewritten, from among a plurality of patterns of display information in which the plurality of sub-fields corresponding to the plurality of adjacent pixels have a same value, a pattern of display information, which corresponds to a smallest change in an average gray-scale level of adjacent pixels, between before and after the rewriting of the display information, is selected.

19. The method of claim 17 further comprising setting a standard pixel the area; and changing gray-scale levels of pixels excluding at least the standard pixel in the area so that the plurality of pieces of display information have in common sub-fields having a same pattern between adjacent pixels.

20. A method for displaying gray-scale images by representing each gray-scale level of the images by an ON/OFF pattern of a set of sub-fields constituting a field in a time domain, comprising:

setting an area, composed of a plurality of adjacent pixels, in response to an input image signal;

generating a plurality of pieces of display information having in common sub-fields with a same pattern between adjacent pixels;

displaying the gray-scale images in accordance with the plurality of pieces of display information;

setting a standard pixel in the area; and adjusting a gray-scale level of a pixel in the area and a gray-scale level of the standard pixel to be equal to each other when a difference between the gray-scale level of the pixel in the area and the gray-scale level of the standard pixel is lower than a value that is determined in accordance with the gray-scale level of the standard pixel indicated in the input image signal.

* * * * *